US005832765A

United States Patent [19]

Ohashi

[11] Patent Number: 5,832,765

[45] Date of Patent: Nov. 10, 1998

[54] METHOD AND AN APPARATUS FOR MANUFACTURING WIRE

[75] Inventor: Kohachiro Ohashi, Tokai, Japan

[73] Assignee: Daido Tokushuko Kabushiki Kaisha, Nagoya, Japan

[21] Appl. No.: 731,267

[22] Filed: Oct. 11, 1996

[30] Foreign Application Priority Data

| | | | |
|---|---|---|---|
| Oct. 14, 1995 | [JP] | Japan | 7-292199 |
| Oct. 14, 1995 | [JP] | Japan | 7-292200 |
| Dec. 29, 1995 | [JP] | Japan | 7-353332 |
| May 17, 1996 | [JP] | Japan | 8-148322 |
| Jul. 22, 1996 | [JP] | Japan | 8-211984 |
| Sep. 24, 1996 | [JP] | Japan | AX9507501D |

[51] Int. Cl.[6] ..... B21B 1/18

[52] U.S. Cl. ..... 72/40; 72/235; 72/247

[58] Field of Search ..... 72/40, 224, 234, 72/235, 247, 248

[56] References Cited

U.S. PATENT DOCUMENTS

| | | | |
|---|---|---|---|
| 3,526,059 | 9/1970 | Trimarchi | 72/40 |
| 4,211,101 | 7/1980 | Krylov et al. | 72/247 |
| 4,807,458 | 2/1989 | Buch et al. | 72/235 |
| 4,969,347 | 11/1990 | Matsuo et al. | 72/247 |
| 5,152,165 | 10/1992 | Shore et al. | 72/235 |
| 5,363,682 | 11/1994 | Takeda et al. | 72/235 |

FOREIGN PATENT DOCUMENTS

| | | | |
|---|---|---|---|
| 2579116 | 9/1986 | France | 72/235 |

*Primary Examiner*—Lowell A. Larson
*Attorney, Agent, or Firm*—Ronald R. Snider

[57] ABSTRACT

The rolling apparatus 1 comprises a first roller-couple 101*a*, 101*b* and a second roller-couple 102*a*,102*b* which are arranged adjacently in a feeding direction of work material A1 and roll the work material A1 in different directions each other successively. Each of the first and second roller-couples comprises two rollers each of which has a groove for determining the cross sectional shape of the wire on the circumferential surface thereof. The width of the grooves are less than 7 mm for the first roller-couple 101*a*,101*b* and are less than 6 mm for the second roller-couple 102*a*,102*b*. The center distance between the first and second roller-couples 101*a*,101*b* and 102*a*,102*b* is less than 50 mm.

43 Claims, 30 Drawing Sheets

(a)

(b)

( U1' > U2' )

(a)

(b)

METHOD AND AN APPARATUS FOR MANUFACTURING WIRE

FIELD OF INVENTION

This invention relates to a method and an apparatus for manufacturing wire, particularly for manufacturing wire with a diameter less than 5.5 mm.

BACKGROUND OF INVENTION

As conventional methods for manufacturing metal wire, metal drawing process, metal rolling process and combinational process of said two ones have been known. The metal drawing method has been used mainly for manufacturing fine wire, wherein work material is successively drawn trough a plurality of drawing dies, wherein the sizing passes successively decreases. On the other hand, in the metal rolling process, work material is successively rolled by a plurality of roller-couples which are alternately arranged so that the angle between the roller axes of adjacent roller-couples is almost 90°. This process achieves a higher productivity in comparison with the metal drawing process.

In many cases of the metal rolling process, the two rollers of each roller-couple have grooves on their rolling surfaces, respectively, which form a sizing pass for determining the cross sectional shape of resulting wire. By using an oval shape of sizing pass for upstream roller-couple and a circular shape of sizing pass for downstream one in adjacent roller-couples, a high wire productivity is achieved since the reduction of area against the work material at each pass of rolling increases.

The metal rolling process, however, has a problem that work material (or wire) is sometimes twisted when it is introduced to the downstream roller-couple from the upstream one. The tendency of occurring such twisting is rather high in the case that the shapes of the sizing passes are different between upstream and downstream roller-couples, particularly in the case of a combination of oval-circular sizing passes. Anyway, the twisting of work material may lead to such trouble as irregular cross section of resulting wire or cutting off of the material.

One of effective methods for preventing the work material from twisting is using auxiliary roller guides for guiding the introduction of the work material to the roller-couple. However, the size of the roller guides becomes smaller with decreasing the diameter of resulting wire, and it becomes substantially impossible to use such roller guides when the diameter of the wire is less than 5.5 mm, so that it has been regarded very difficult to produce fine wire with a diameter less than 5.5 mm through the metal rolling process.

Therefore, in the process of the prior art for manufacturing such fine wire, first the work material is rolled to the diameter around 5.5 mm, and next drawn by using drawing dies to a designated diameter less than 5.5 mm. This process, however, has a disadvantage that the high productivity of the metal rolling process is reduced because the metal drawing process, whose productivity is rather low, should be combined. Furthermore, the metal drawing process can be applied only for the cold working process, so that for producing wires of work-difficult materials such as high speed tool steel or high alloy steel, stress relief annealing should be performed every designated number of drawing passes, so that the productivity becomes further worse.

The object of this invention is to offer a method and an apparatus for manufacturing wire with a diameter less than 5.5 mm which achieves a high productivity and high quality of wire.

SUMMARY OF THE INVENTION

This invention relates to a method and an apparatus for manufacturing wire by rolling work material successively with a first roller-couple and a second roller-couple which are arranged adjacently in a feeding (or transportation) direction of the work material and roll the work material in different directions each other.

For accomplishing the aforementioned problem, the method of this invention is characterized by that the first and second roller-couples are arranged so that the ratio of L/D is less than 30, where L is a center distance between the first and the second roller-couples, and D is a wire diameter obtained after the rolling by the second roller-couple, the work material is rolled by the roller-couples so that reduction of area of the work material achieved by each roller-couples is 5–35%, and resulting wire diameter is less than 5.5 mm.

The inventor has discovered that an adjacent arrangement of the first and the second roller-couples with L/D less than 30 may effectively protect the work material from said twisting during rolling without using any roller guides, thereby enabling production of wire with a diameter less than 5.5 mm by a metal rolling process and achieving very high efficiency of production of such fine wire in comparison with conventional method such as metal drawing process.

The reduction of area of the work material achieved by each roller-couples is set in a range of 5–35%. The reduction of area less than 5% leads to a poor wire productivity, and that exceeding 35% causes excess degree of working which may lead to a generation of faults in the work material or damaging the rollers. The reduction of area is preferably set in a range of 10–30%.

The apparatus of this invention comprises said first and second roller-couples. At least one of the first and second roller-couples can be constructed so as to comprise two rollers each of which has a groove on the circumferential surface thereof for forming a sizing pass, which determines the cross sectional shape of the wire. According to this construction, the cross section of the wire may be precisely formed in a designated shape. The optimization for the shapes of the sizing passes of the first and the second roller-couples may improve the wire productivity with maintaining high accuracy of dimension and good working condition of the wire since high reduction of area may be achieved for each pass of rolling.

For achieving a wire diameter less than 5.5 mm, the width of the grooves is set to be less than 7 mm for the first roller-couple and less than 6 mm for the second roller-couple. On the other hand, the wire may by produced by using a roller-couple having flat rolling surfaces without grooves. In this case, the clearance formed between two rollers is less than 7 mm for the first roller-couple and less than 6 mm for the second roller-couple. In both of the constructions, the center distance between the first and the second roller-couples, L, is set to be less than 50 mm. The inventor has also discovered that an adjacent arrangement of the first and the second roller-couples with the center distance L less than 50 mm may effectively protect the work material from said twisting during rolling.

For preventing the work material from twisting, the center distance L is preferably set to be as short as possible with a range where no interference occurs between the adjacent roller-couples. Specifically, the center distance L can be determined according to the outer diameter of each roller. When the outer diameter, d, of the rollers of the first roller-couple is the same as that of the second roller-couple, the ratio L/d is preferably set to be less than 1.2, and more preferably less than 1.0.

The first and second roller-couples may be arranged alternatingly so that the angle between the rotation axes thereof is almost 90°. More specifically, the first roller-couple can be constructed so as to roll the work material so that the cross sectional dimension of the work material in a direction of rolling reduction, D1, becomes shorter than that in a direction perpendicular to the direction of rolling reduction, D2, and the second roller-couple rolls the work material so that the ratio of the dimensions, D2/D1, is decreased. According to this configuration, a high reduction of area may be achieved for each pass of rolling, whereby the wire productivity improves.

The sizing passes may be formed in different shapes between the first and the second roller-couples, whereby the wire productivity improves while a high dimensional accuracy and a good working condition are maintained. For example, the sizing pass may be formed in an oval shape for the first roller-couple and in a circular shape for the second roller-couple. Such configuration of sizing passes achieves high dimensional accuracy and productivity of wire having a circular cross section.

The apparatus can be constructed so that a plurality of roller-couple units each of which comprises the first and the second roller-couples can be arranged in the feeding direction of the work material, and the work material may be successively rolled by the roller-couple units. According to such configuration, the work material can be rolled successively, so that fine wire may be produced even from work material with a large cross section.

The final diameter of the wire produced is preferably set in a range of 1.30–5.40 mm for achieving high dimensional accuracy of wire and for suppressing the frequency of faults in the resulting wire, whereby the superiority in wire productivity against the conventional method, such as the metal drawing process, becomes very significant.

Although the variety of the work material is not limited to a particular one, this invention is particularly advantageous for producing wire of work-difficult iron-based materials, such as high speed tool steels, stainless steels and other high alloy steels, whose efficient production has been regarded to be difficult. However, this invention can be applied also to any other iron-based material such as soft steels, cold-workable carbon steels, alloy tool steels, and non-iron based metals such as Ni alloy and Ti alloy (for example, Ni—Ti based shape memory alloy), and so on.

The rolling temperature of the work material can be chosen arbitrarily according to the variety thereof. For a material with a high deformation resistance at a room temperature, a high rolling temperature is preferable for improving wire productivity since the deformation resistance decreases thereby increasing the reduction of area. Furthermore, such high rolling temperature may suppress the increase in the work stress according to the recovery or the recrystarization of the work material during rolling, so that no process annealing for stress relief or for reducing hardness is needed, whereby the advantage in the productivity becomes more significant.

In the case of iron-based work material, the temperature of the material when it is introduced to the first roller-couple is preferably adjusted in a range of 400°–1300° C. The temperature below 400° C. makes the effect of decreasing the deformation resistance insufficient, and that over 1300° C. causes oversoftening of the work material which leads to buckling or twisting thereof, so that normal rolling becomes impossible.

In the case of using a plurality of roller-couple units for successively rolling the work material, the temperature of the material can be maintained in the temperature range mentioned above when it is introduced into the first roller-couple of the first unit.

Several kinds of work material have further preferable temperature range for rolling. For example, high speed tool steels is preferably rolled in a range of 800°–1150° C. Rolling temperature below 800° C. deteriorates not only the deformation resistance of the material but also the ductility, toughness and post-quenching hardness of the material since micro-voids are formed in the texture of the material due to cracking of carbides. On the other hand, temperature over 1150° C. causes coarsening of carbides in the texture of the material, which decreases the strength of the wire obtained.

The hot-rolling process according to the method of this invention is preferably performed as follows. The method comprises steps of continuously removing scale formed on work material in feeding by using a scale-removing device arranged on the passage of said work feeding, and heating the work material after the removal of the scale by using a heating device which comprises an electrode contacting with the work material allowing continuous feeding thereof and sending electric current into the work material through the electrode for resistance-heating of the work material. The heated work material is rolled by using a rolling mill so that resulting diameter of wire is less than 5.5 mm. Since the scale formed on the work material is preliminarily removed and then heated by a resistance heating method through the electrode, the contact between the work material and the electrode becomes reliable and stable, and spark generation is suppressed therebetween, so that high quality of fine wire can be produced with a large yield.

The heating step may be performed so that the work material in feeding is heated by a heating device which is arranged on the passage of said transportation and comprises an induction heating coil. This configuration comprises no electrode contacting with the work material, so that no spark occurs during heating whereby fine wire can be produced with high quality and a large yield.

The distance between the heating device and the rolling mill is preferably set to be less than 4 m. In the hot-rolling process for fine wire, the heated work material tends to be cooled quickly because of its small diameter. In this case, work-difficult materials, such as high speed tool steels, stainless steels, super alloys, Ti alloys (for example, Ti—Ni based shape memory alloys), and so on, have considerable narrow temperature range suitable for hot-rolling and apt to occur cracks or other faults during rolling if the material is cooled below the optimum temperature range. However, when said distance is set to be less than 4 m, the work material can be immediately introduced into the roller-couples, so that said cooling of the material and relating faults may be effectively prevented. The distance between the heating device and the rolling mill is more preferably set to be less than 3 m.

The preferable construction of the apparatus for performing the hot-rolling method mentioned above comprises the afore-mentioned rolling mill and following elements:

(1) a scale-removing device which is arranged on the passage of feeding of the work material and continuously removes the scale formed on said work material in continuous feeding; and (2) a heating device for heating the work material after the removal of the scale comprising an electrode contacting with the work material allowing the feeding thereof and sending electric current into the work material through the electrode for resistance-heating of the work material.

The scale-removing device may comprise a shot-blasting device which removes the scale by blasting a flow of abrasive particles onto the surface of the work material in continuous feeding. According to this construction, the scale on the surface of the work material can be effectively removed.

The heating device can be constructed so as to comprise a roller electrode which contacts with the work material and sends electric current into the work material for its resistance-heating and an urging mechanism which urges the roller electrode against the work material. According to this construction, the contact between the roller electrode and the work material becomes more reliable. In this case, a groove is preferably formed on the circumferential surface of the roller electrode for guiding the feeding of the work material. The urging mechanism may be constructed as a spring mechanism or a pressure cylinder mechanism comprising an air or hydraulic cylinder. The pressure cylinder mechanism comprising an air cylinder is particularly preferable since the urging pressure of the roller electrode against the work material can be adjusted easily.

The heating device may be constructed so as to comprise an induction heating coil for heating said work material in continuous feeding which is arranged on the passage of the feeding.

The rolling reduction against the work material by each roller-couple can be varied according to the variety of the work material, and the ratio, R1/R2, where R1 and R2 are roller-rotation rates in the first and second roller-couple, respectively, can be adjusted according to the rolling reduction. In this case, the rolling reduction and the ratio R1/R2 can be varied according to the torsional rigidity of the work material. The function and effect of this configuration is as follows.

The probability of occurrence of the wire twisting specifically depends upon the torsional rigidity of the work material. For example, as is shown in FIG. 30 (*a*), when the rolling reduction is increased for the first roller-couple, the work material (A1) is deformed largely in the direction of the compression (or rolling) between the rollers. The resulting shape of the cross section of the work material is to be elongated along the direction perpendicular to said compression and cause a significant twisting torque upon the work material when a secondary rolling is performed in the direction crossing to the primary one. This means that a work material having a low torsional rigidity is apt to be twisted when the rolling reduction is increased for the first roller-couple. Therefore, such twisting of wire may be effectively prevented by adjusting the rolling reduction according to the variety of the work material, particularly to the torsional rigidity thereof.

In this case, the change in the rolling reduction at the first roller-couple causes a change in the reduction of area achieved thereat, so that the feeding rate of the work material from the first roller-couple, i.e., the feeding rate to the second roller-couple should be also changed. Therefore, by changing the rotation rate of the second roller-couple corresponding to the change in the feeding rate of the work material, i.e., by changing the ratio R1/R2, the rolling may be performed smoothly upon the work material even if the rolling reduction is varied.

On the other hand, the resulting wire diameter can be varied in a designated range by changing the rolling reductions in the first and second roller-couples against the work material in a corresponding range. According to this construction, there is no need to substitute current rollers with other ones having different configuration of sizing pass for changing the wire diameter, whereby wires having various diameter can be produced efficiently.

In the case that the ratio of roller rotation rates R1/R2 is fixed in a designated value, the total rolling reduction against said work material by the first and second roller-couples can be varied so that resulting change in the reduction of area of the work material is within 10%. The inventor discovered that even if the rolling reduction is changed at a fixed value of R1/R2, the rolling can be maintained in a excellent condition. In other words, the wire diameter can be changed without changing the sizing pass of the roller-couple as long as the change in the reduction of area is within 10%. This contributes significantly for increasing productivity of wires having various diameters. In this case, the change in the rolling reduction is preferably maintained within 7%.

If the ratio R1/R2 is varied according to the value of the total rolling reduction against the work material, the total rolling reduction can be varied so that resulting change in the reduction of area of said work material is up to 40%. When the rolling reduction exceeds certain upper limit, the reduction of area at the first roller-couple increases, whereby the increase in the feeding rate of the work material from the first roller-couple, i.e., to the second one becomes no longer negligible. However, if the roller-rotation ratio R1/R2 is changed corresponding to the change in said transportation rate, the rolling can be performed smoothly even the rolling reduction is changes in such wider range. In this case, the shapes and/or sizes of sizing passes of the first and the second roller-couples are preferably changed according to the value of said total rolling reduction against said work material for maintaining the cross sectional shape of the resulting wire in a good condition.

In the case of changing R1/R2, the first and the second roller-couples can be driven by a common driving means through a first and a second reduction gear systems, respectively, and the inter-stand reduction ratio, Q1/Q2, where Q1 is the reduction gear ratio of said first reduction gear system and Q2 is the reduction gear ratio of said second reduction gear system, may be varied for changing the ratio R1/R2. According to this configuration, a common driving means is used for the first and the second roller-couples, so that the construction of the apparatus becomes simple.

Furthermore, in a configuration wherein a plurality of roller-couple units each of which comprises the first and second roller-couples are arranged in the feeding direction of said work material and the work material is successively rolled in each roller-couple units, the inter-stand reduction ratios Q1/Q2 of the roller-couple units can be changed synchronously. In this construction, when the inter-stand reduction ratio is set in a designated value for one of roller-couple units, the inter-stand reduction ratios for other roller-couple units are also set in corresponding values synchronously. According to this construction, even in the case of using many roller-couple units, the roller reductions and inter-stand reduction ratios may be easily changed corresponding to the torsional rigidity of the work material, and so on.

The clearances between two rollers of the first and second roller-couples can be changed by a roller-clearance adjusting mechanism which moves the two rollers of each roller-couple relatively to and from each other in the direction of rolling reduction. Such roller-clearance adjusting mechanism can be constructed so as to comprise bearing portions which rotatively support the shafts of the two rollers, respectively, and a bearing rotation mechanism which rotates each bearing portion around an eccentric axis deviated from a corresponding roller axis in opposite direction, respectively, thereby moving the two rollers relatively to and from each other. This configuration accomplishes a simple and compact mechanism for changing the roller spacing.

The bearing rotation mechanism for the first roller-couple can be arranged upstream of the first roller-couple, and that for the second roller-couple can be arranged downstream of the second roller-couple. This configuration is preferable for accomplishing the proximate arrangement of the first and the second roller-couples with a center distant L within 50 mm since no bearing rotation mechanism is located between these roller-couples, so that there is no need to prepare auxiliary roller guides for guiding the work material to the second roller-couple.

The bearing rotation mechanism can be constructed so as to comprise first gear portions which are formed on the circumferences of the bearing portions of the two rollers, respectively, second gear portions each of which engages with corresponding first gear portion, and a driving mechanism which rotates the second gear portions synchronously in opposite directions each other.

The second gear portions can be specifically constructed as worms which are axially formed on a worm rotating shaft at an designated intervals along the longitudinal direction thereof and whose threads are formed in opposite directions each other. The driving mechanism drives the worm rotating shaft for rotating said worms integrally. This configuration accomplishes a simple and compact construction of the bearing rotation mechanism.

In a further specified construction of the apparatus, the bearing portion comprises bearing casings which are arranged corresponding to both end portions of each roller shaft and each of which has a bearing accommodating hole extending along said roller shaft, a bearing main body which is accommodated in each said bearing accommodating hole. In this construction, a bearing hole is formed in each bearing main body so that the center of said bearing hole is deviated from the rotation axis of the bearing main body. Each end portion of each roller shaft is rotatively supported in the bearing hole, and the bearing main body has the first gear portion on its circumference and is rotated by the worm engaged with the first gear portion around an eccentric axis deviated from the rotation axis of the roller.

The bearing hole of the first roller couple can be formed in the bearing main body deviated from its rotation axis in the downstream, and the bearing hole of said second roller couple can be formed in the bearing main body deviated from its rotation axis in the upstream. In addition, each corresponding worm rotating shaft van be arranged in the similar manner. This configuration is preferable for accomplishing the proximate arrangement of the first and the second roller-couples.

At least one of said first and second roller-couples can be equipped with a roller thrust adjusting mechanism which moves the two rollers relatively in the thrust direction thereof and hold these two rollers at an arbitrary positions in the thrust direction. As is shown in FIG. 19 (*b*), the thrust displacement between two rollers of the roller-couple is one of major factor of causing wire twisting during rolling. In this case, as shown in FIG. 19 (*a*), if these two rollers (101*a*, 101*b*) are precisely positioned, the distance line (U1, U2) between the inner surfaces of the grooves (161*a*, 161*b*) of said two rollers trough the center (O) of the sizing pass (161*c*) becomes uniform, thereby providing uniform compression against the work material. Therefore, the twisting of the work material becomes to be difficult to occur since the twisting torque against the work material is suppressed.

Such adjustment of the two rollers in the trust direction can be performed by using said roller thrust adjusting mechanism, and the thrust displacement in these two rollers can be dissolved by an adjustment of the position of each roller (thrust adjustment, hereinafter). On the other hand, such roller displacement in the thrust direction may causes an irregularity of the cross sectional shape of the resulting wire. However, aforementioned thrust adjustment of the rollers can simultaneously dissolve such problem. Furthermore, even if the surface accuracy of the sizing pass is not very high, a designated level of the dimensional accuracy of the wire can be secured by such thrust adjustment.

The roller thrust adjusting mechanism can be constructed so as to comprise a fixed bearing portion which is provided for at least one of the two rollers and holds the roller shaft rotatively, and movably in its thrust direction, and a roller sliding mechanism which is connected to one end portion of the roller shaft and slides the roller shaft against the bearing portion in the thrust direction.

The roller sliding mechanism can comprise a shaft holder to which the end portion of the roller shaft is connected and which is movable integrally with the roller shaft in the thrust direction, adjusting screw mechanism which is connected to the shaft holder directly or indirectly with other member and moves the shaft holder in the thrust direction according to its screwing or unscrewing operation. According to the operation of such adjusting screw mechanism, said thrust adjustment of the rollers can be easily performed.

A further specified configuration can be constructed as follows. The bearing portion comprises a bearing main body which has a through hole as a bearing hole in the direction of the roller shaft and rotatively supports the one end portion of the roller shaft in the through hole. The shaft holder is movable in the through hole with the roller shaft in the thrust direction. The shaft holder has a shaft-like protruding portion which extends along the axial direction of the roller shaft in the through hole and the end portion of which protrudes outside from the corresponding opening of the through hole. On the inner side of the through hole, a female threaded portion is formed on the end portion thereof leading to the opening. A male screw member is screwed on the female threaded portion in a position corresponding to the intermediary part of the shaft-like protruding portion. A stopper is mounted on the shaft-like protruding portion for preventing the male screw member from its relative moving against the shaft-like protruding portion in the axial direction thereof. The adjusting screw mechanism moves the shaft holder and the roller shaft in the thrust direction along with the male screw member according to the rotation of the male screw member. The adjusting screw mechanism becomes compact according to this configuration.

BRIEF DESCRIPTION OF DRAWINGS

In the accompanying drawings:

FIG. 2(*b*) is a schematic view presenting the cross sectional shape of the second sizing pass of the second roller couple.

FIG. 2(*c*) shows the transition from circular to oval to circular cross sections as the circular cross section is reduced from $A_1$ to $A_2$.

FIG. (*b*) is a figure explaining the function of the roller thrust adjusting mechanism when the roller is moved to the right.

Figure 17A:
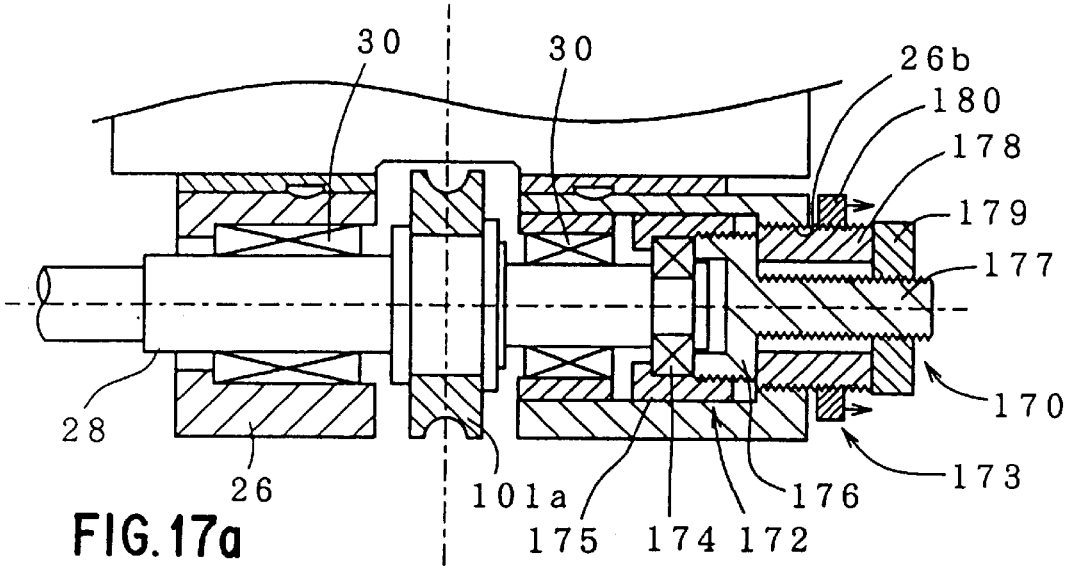
FIG. 17(*a*) is a figure explaining the function of the roller thrust adjusting mechanism.
Figure 17B:
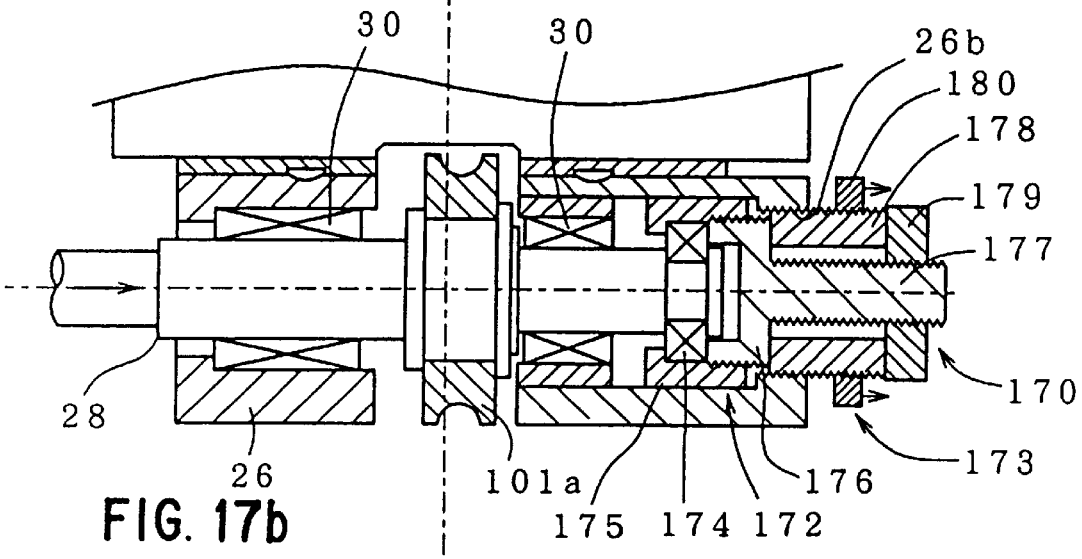
Figure 17C:
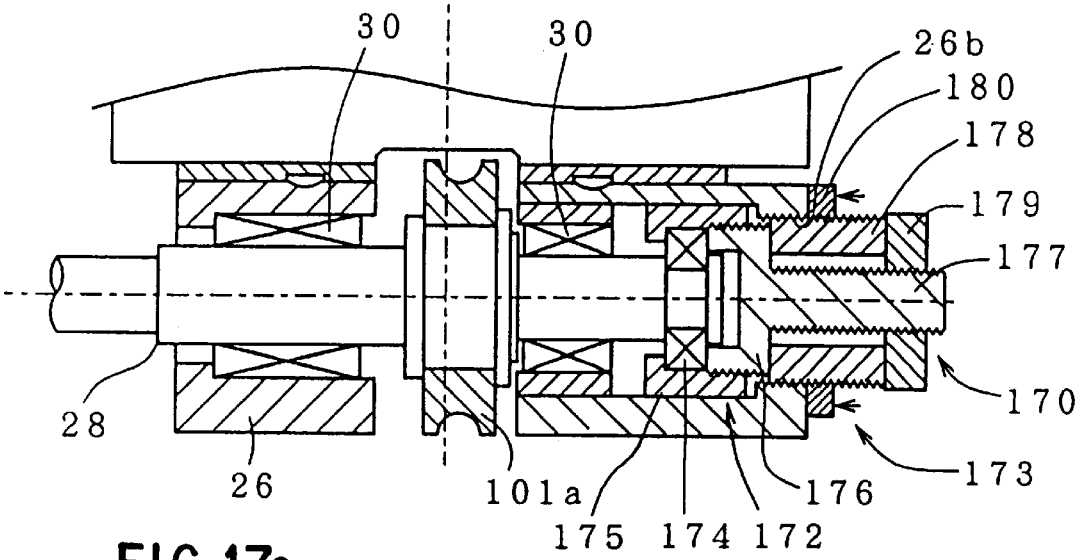

FIG. 17(*c*) is a figure explaining the function of the roller thrust adjusting mechanism when the roller is locked in the right-hand position.

Figure 18A:
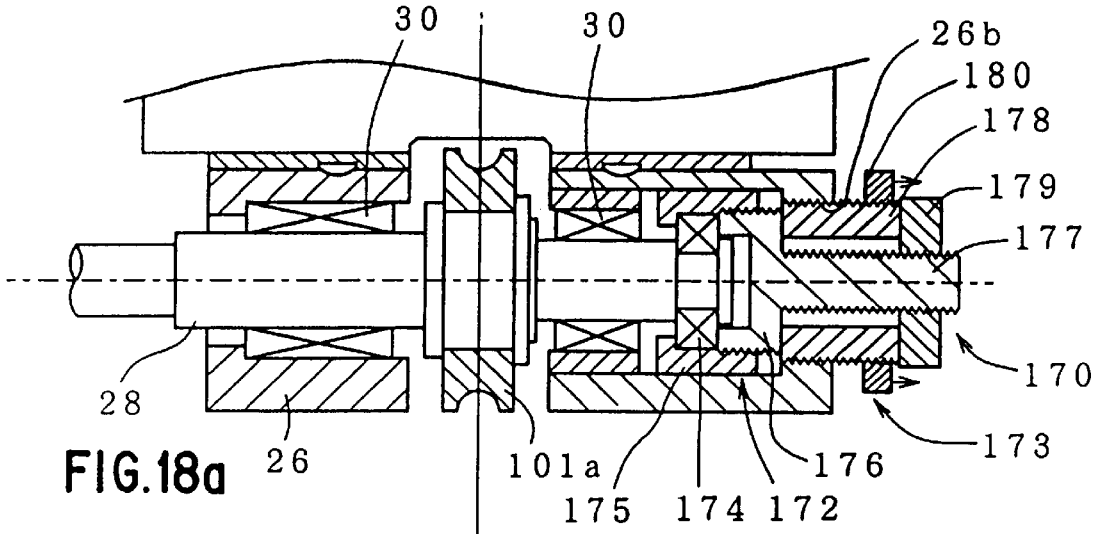
Figure 18B:
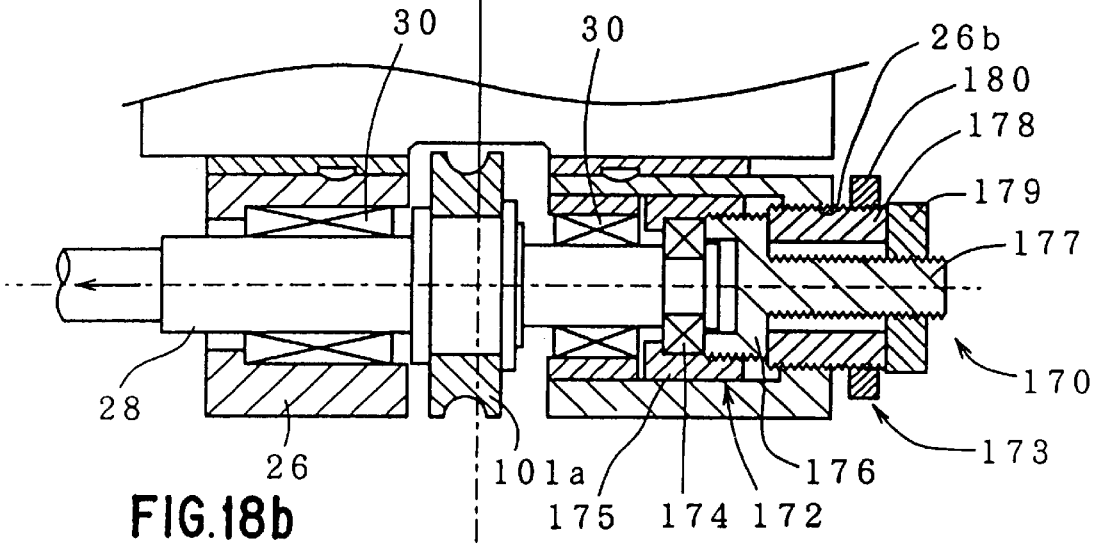
Figure 18C:
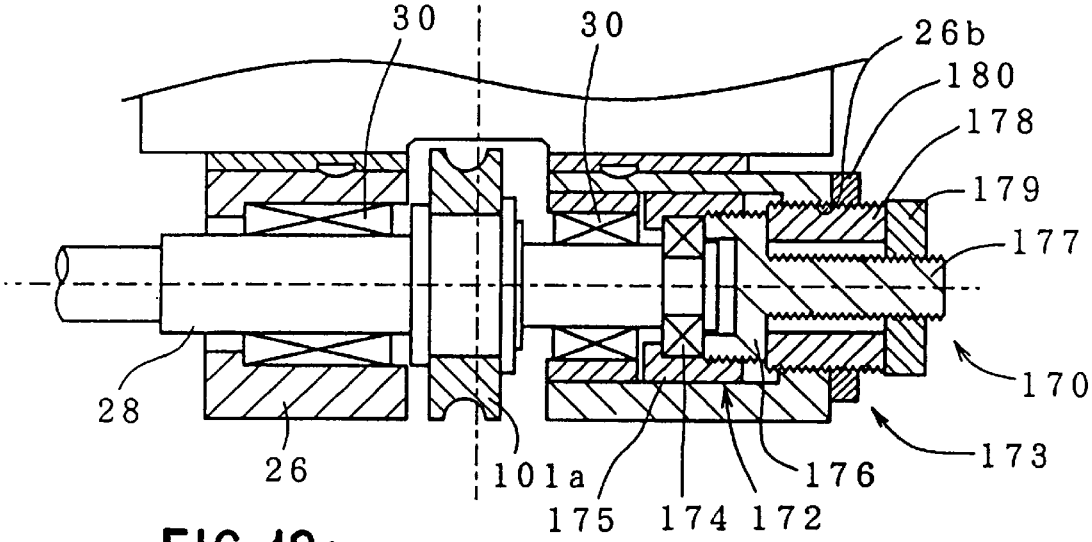

FIG. 18(*a*) is a figure explaining the function of the roller thrust adjusting mechanism;

FIG. 18(*b*) shows adjustment of the roller when moved to the left.

FIG. 18(*c*) shows locking of the roller in position in the left-hand side position.

Figure 19A:
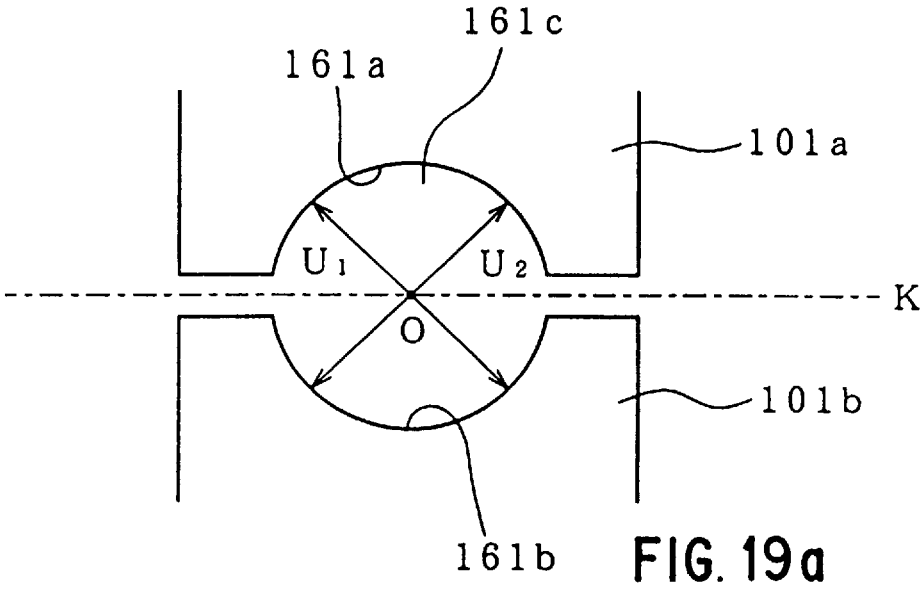
Figure 19B:
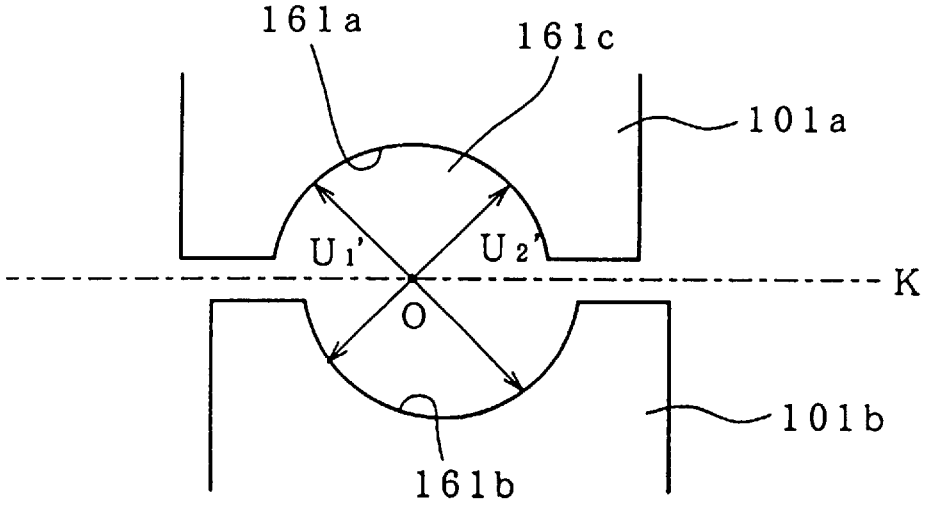
Figure 20:
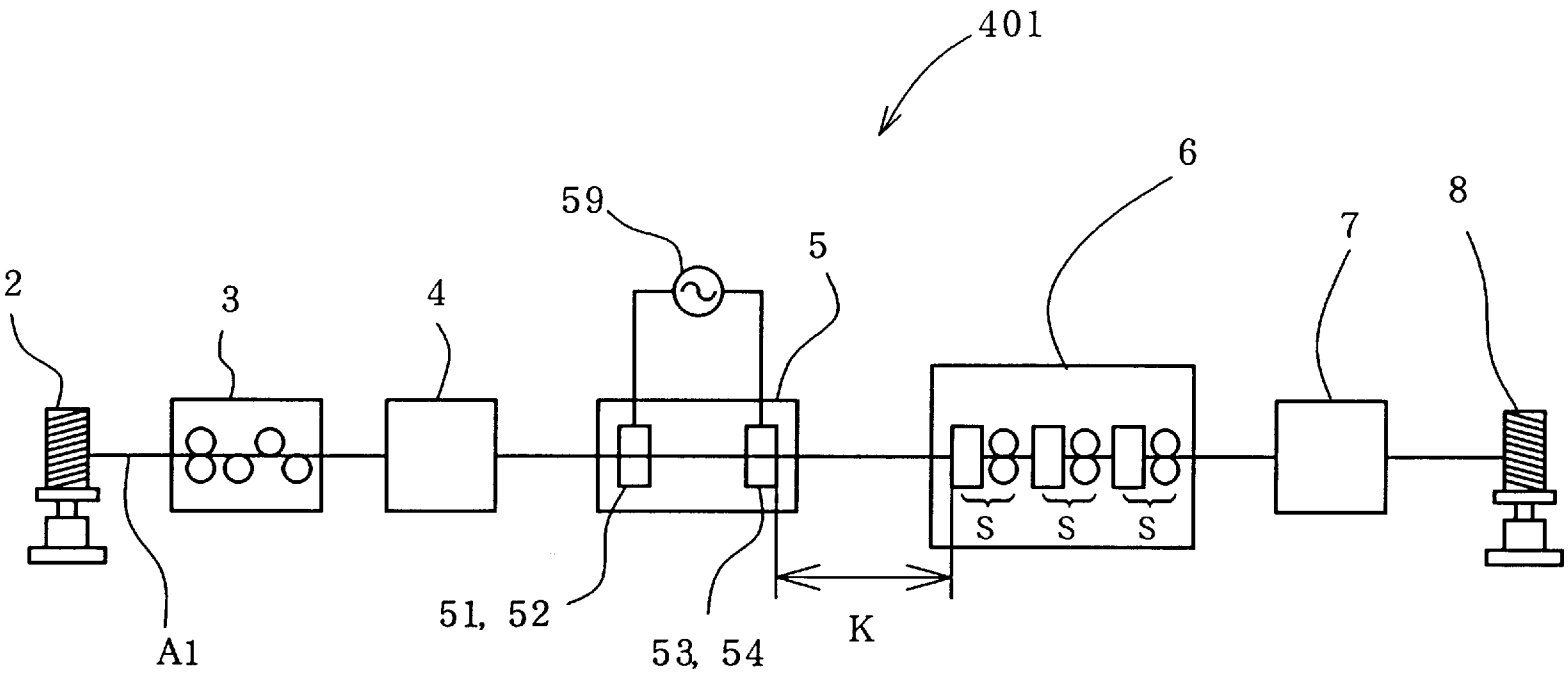
Figure 21B:
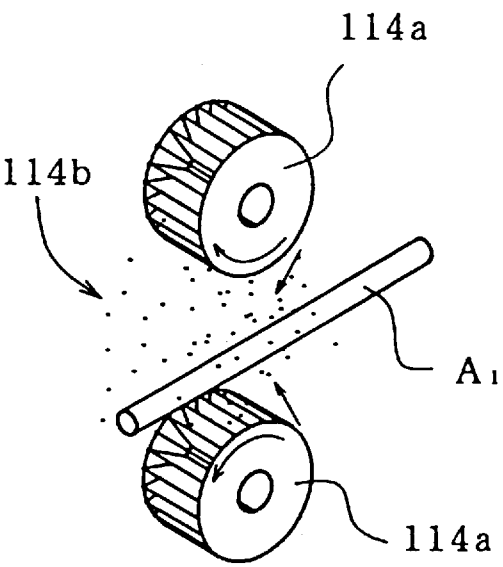
Figure 21A:
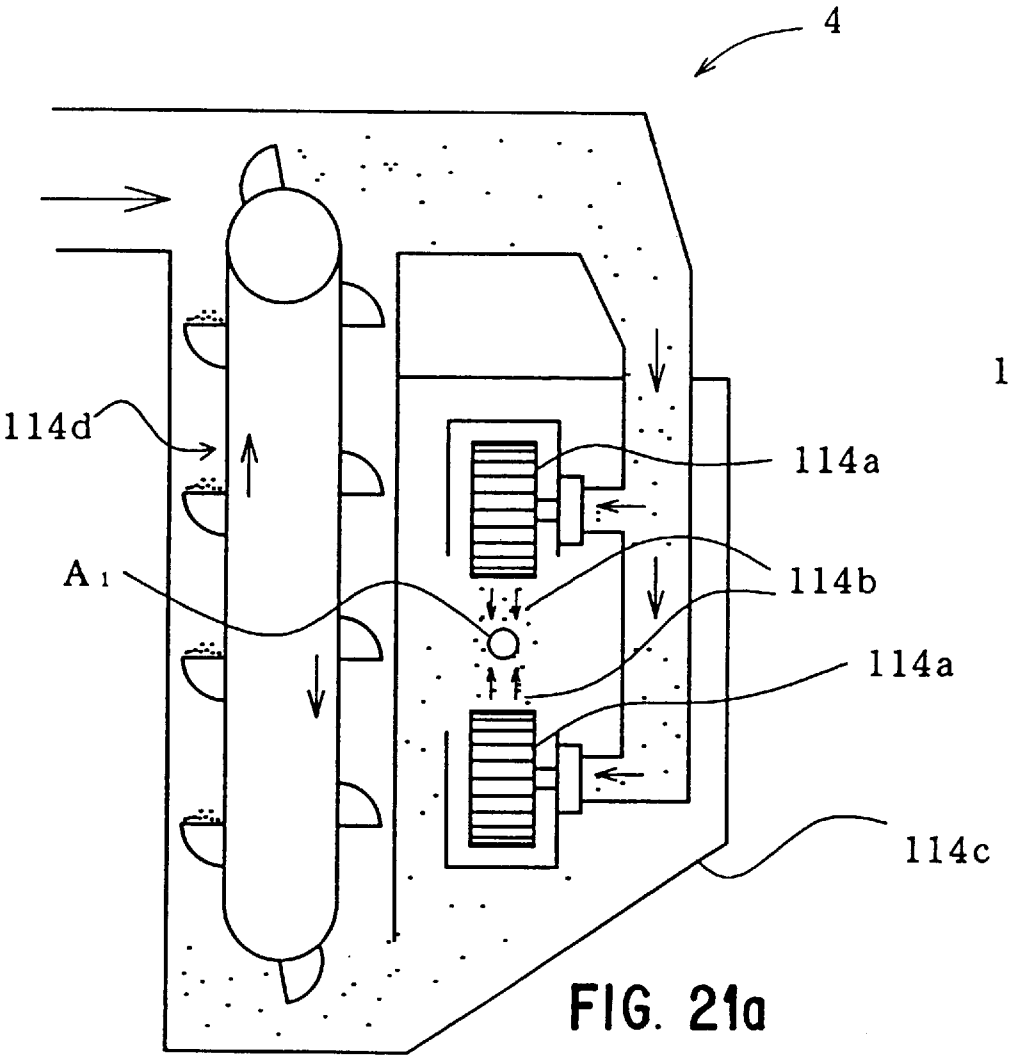
Figure 22A:
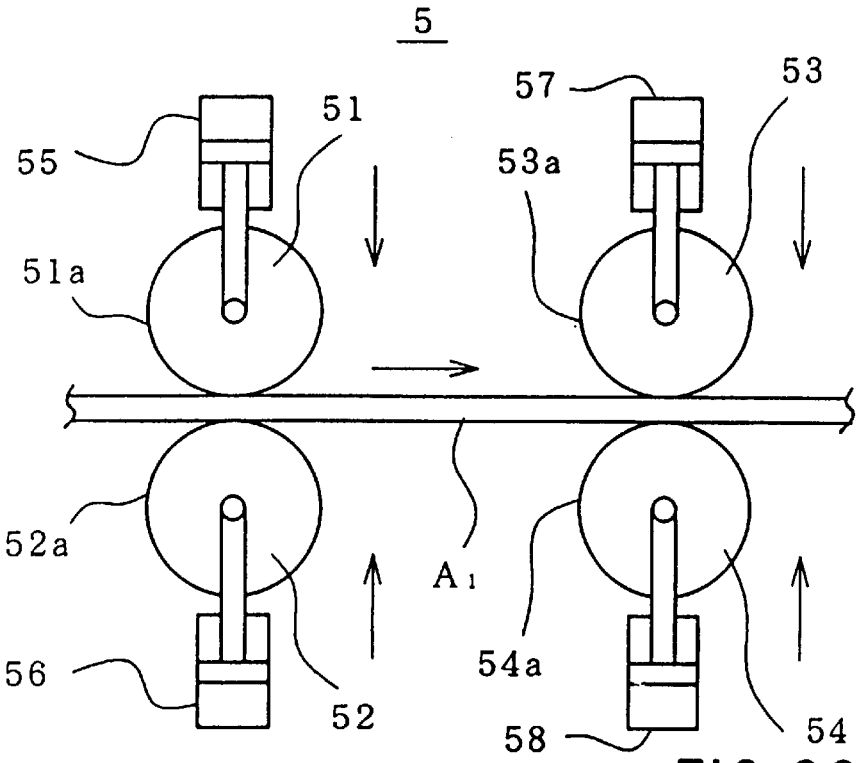
Figure 22B:
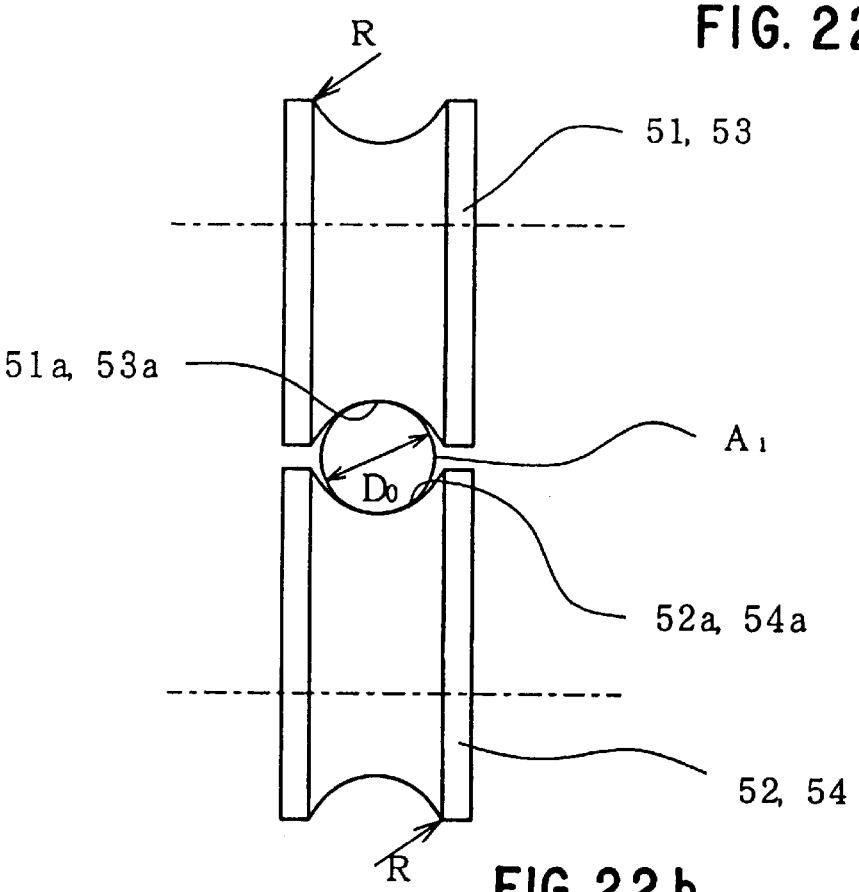
Figure 23:
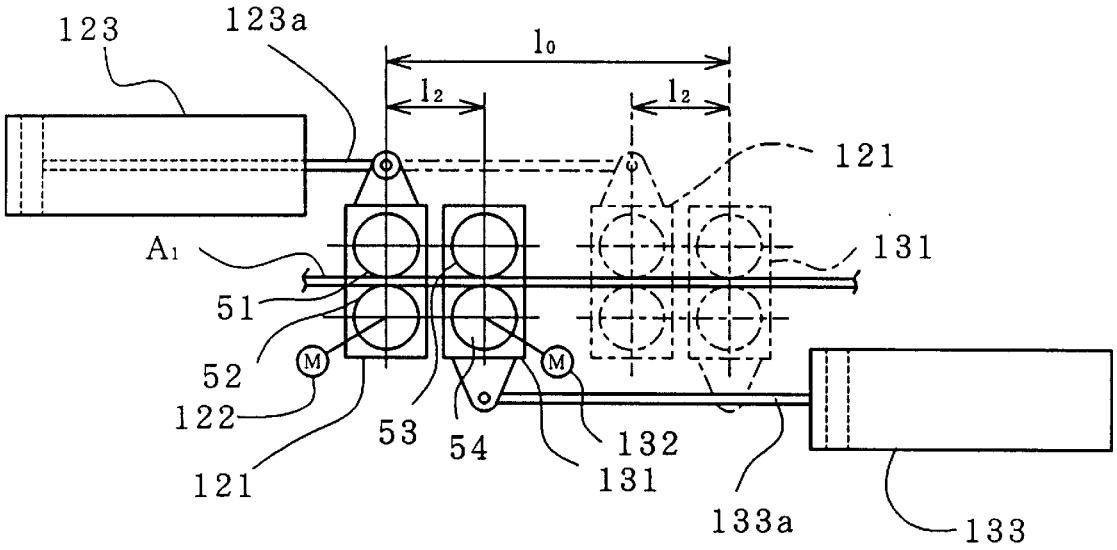
Figure 24A:
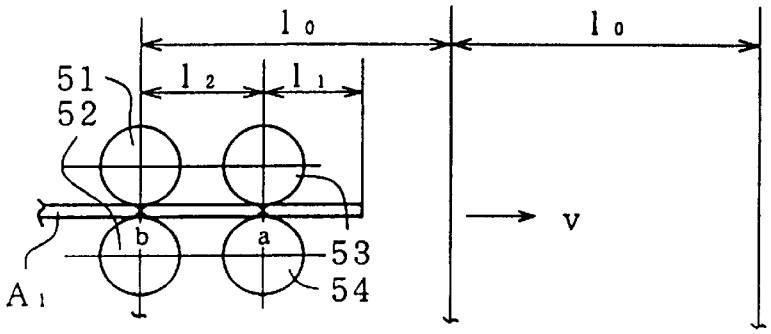
Figure 24B:
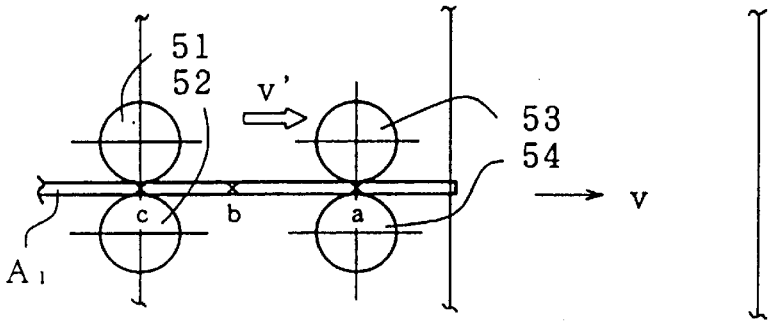
Figure 24C:
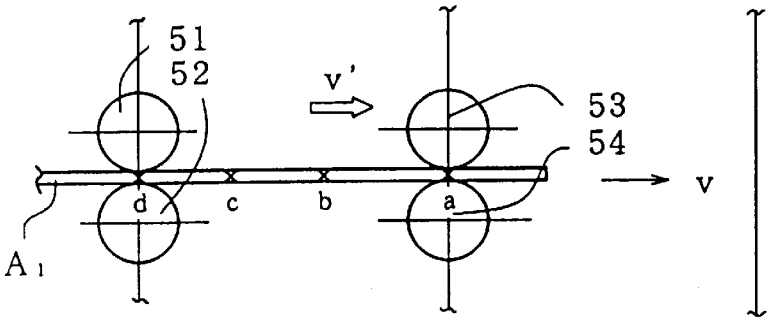
Figure 24D:
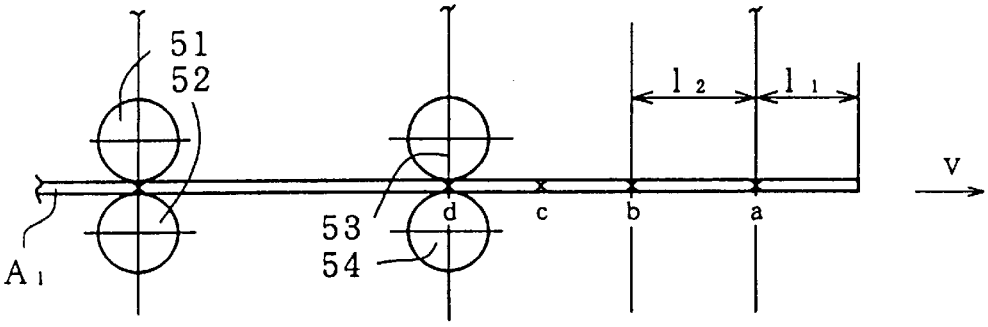
Figure 25A:
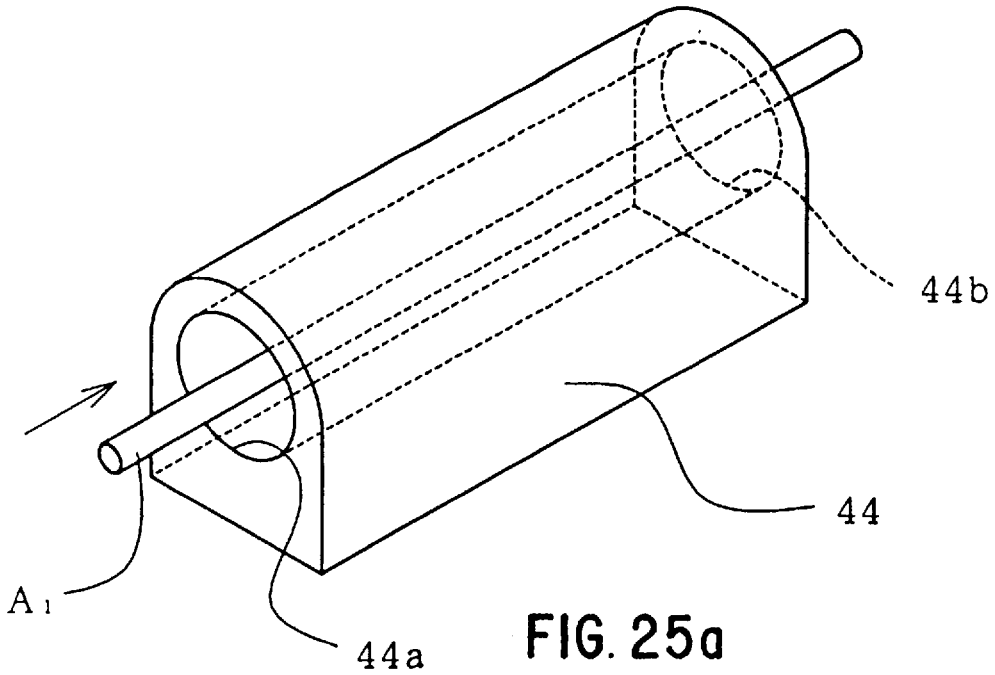
Figure 25B:
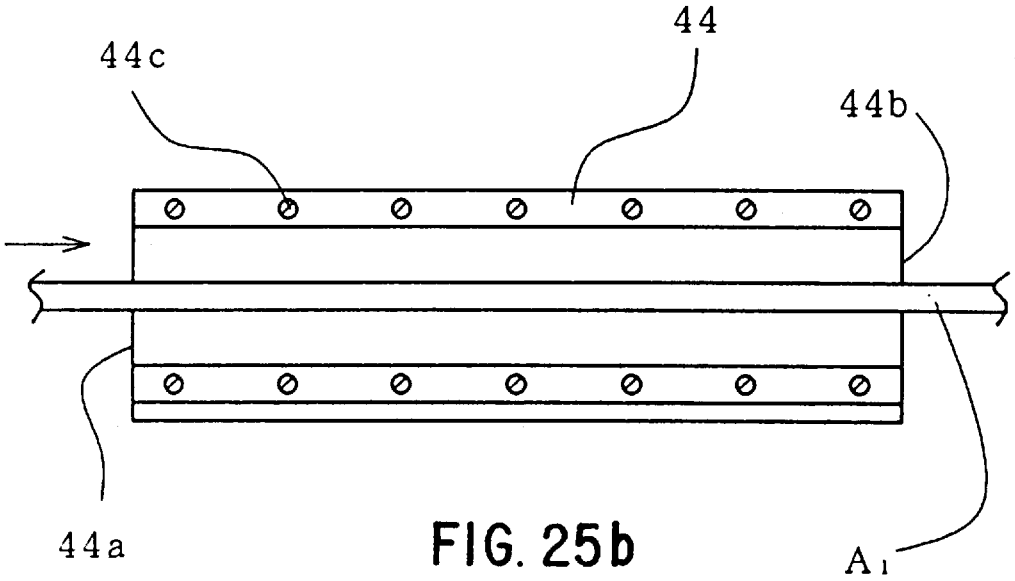
Figure 26:
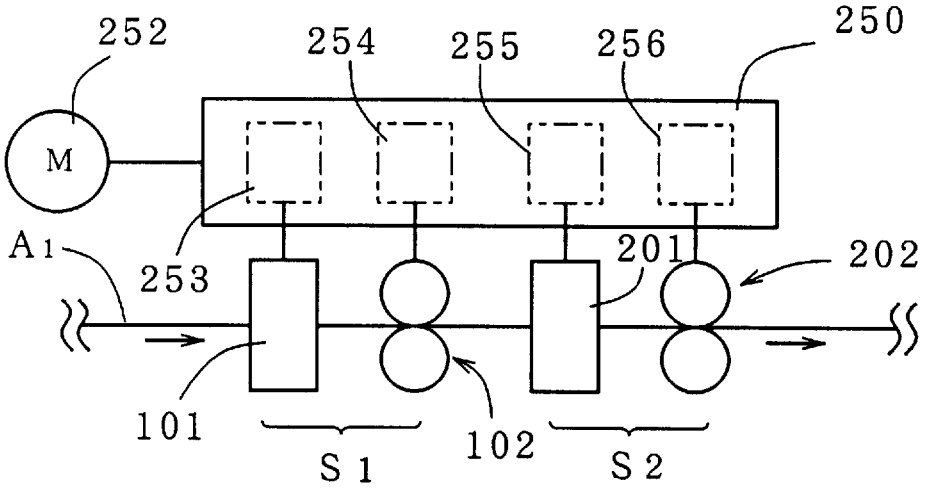
Figure 27:
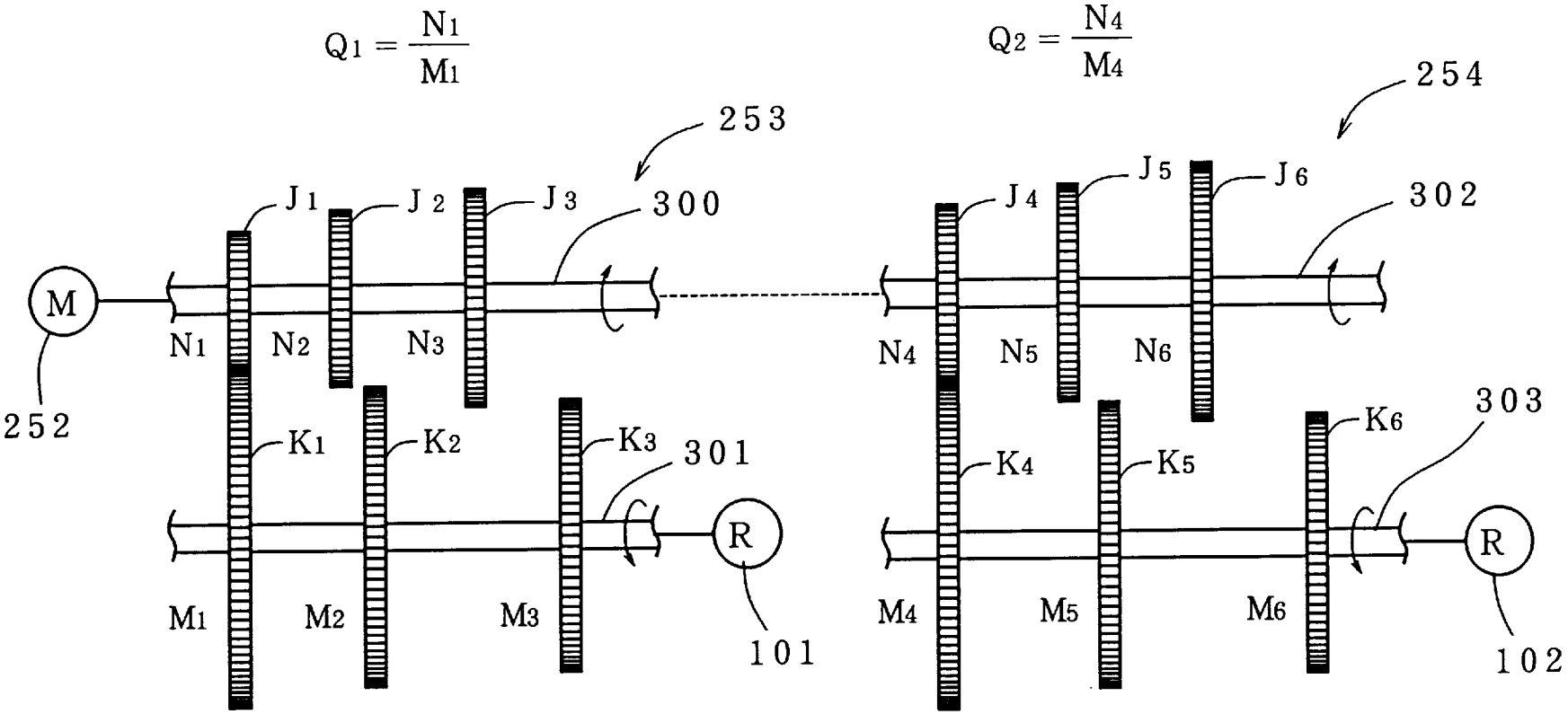
Figure 28:
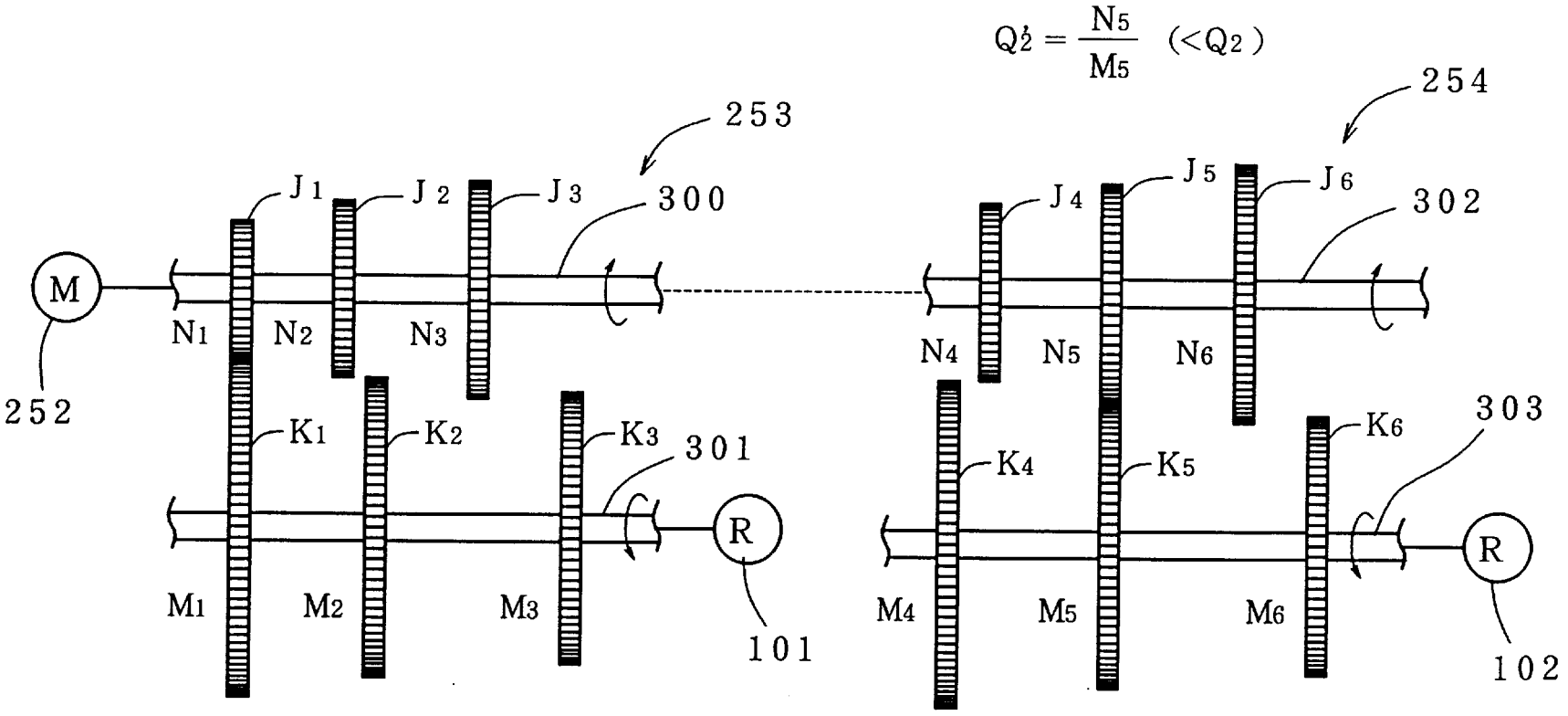
Figure 29:
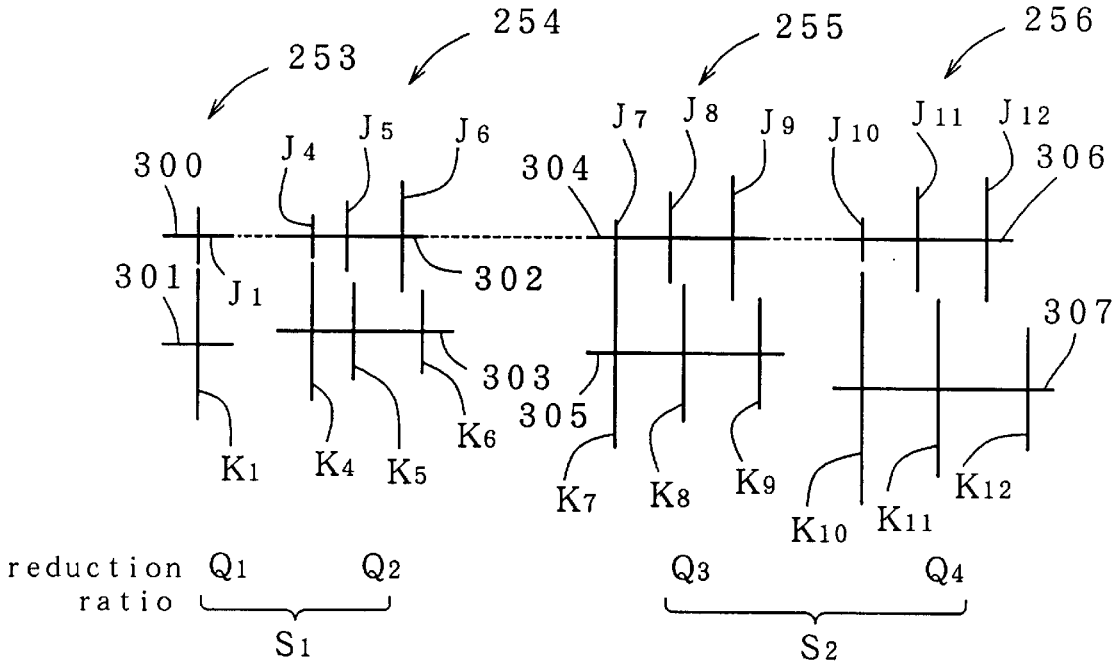
Figure 29:
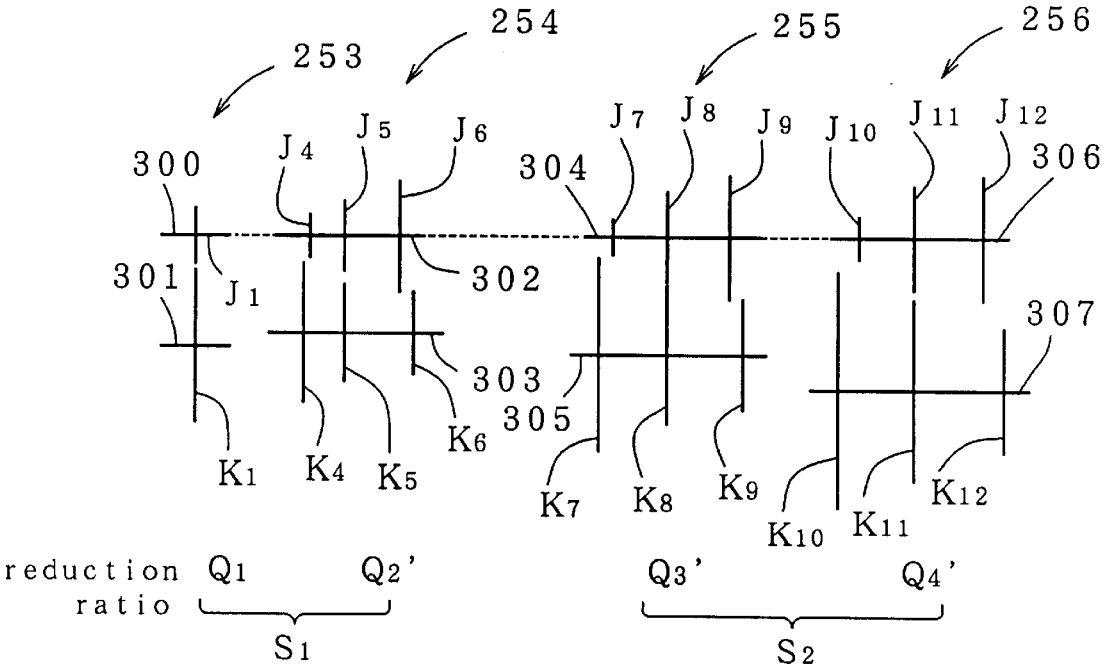
Figure 30A:
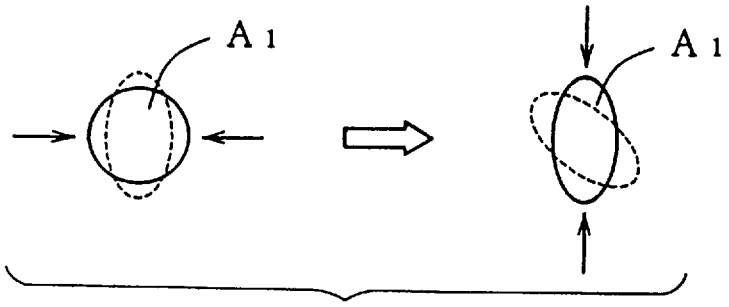
Figure 30B:
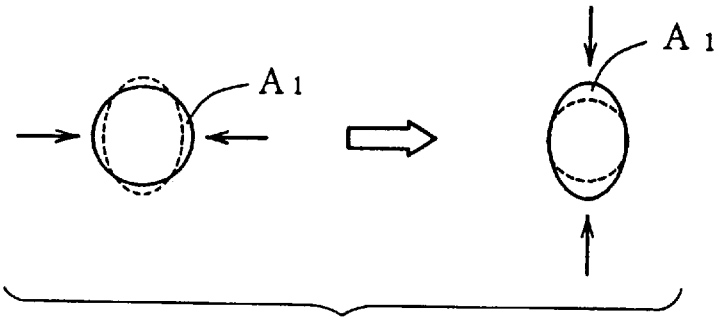
Figure 31C:
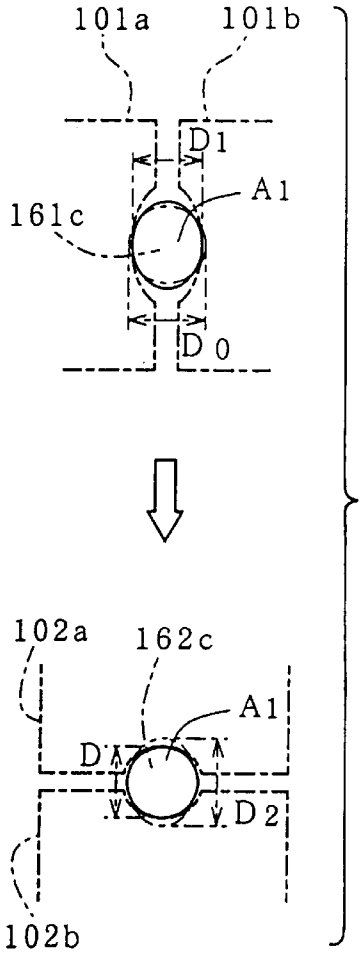
Figure 31B:
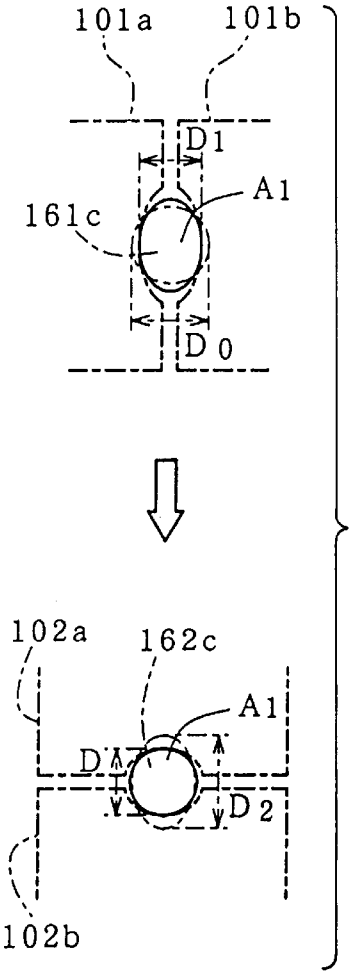
Figure 31A:
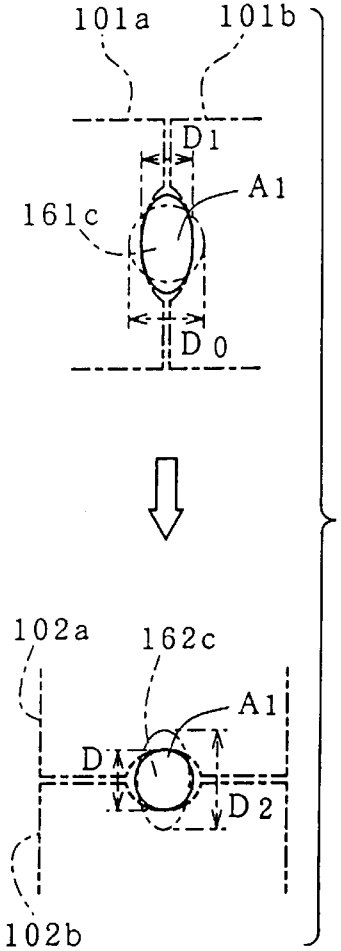

FIGS. 19(*a*) and 19(*b*) are Figures explaining the influence of thrust displacement of the rollers upon the work material;

FIG. 20 is a sectional view conceptually presenting one embodiment of a hot-rolling line for wire production;

FIGS. 21(*a*) and 21(*b*) are schematics of a shot-blasting device;

FIGS. 22(*a*) and 22(*b*) are Figures presenting a main part of an example of resistance-heating device with along the function thereof;

FIG. 23 is a schematic view presenting an example of a heating device comprising movable roller electrode FIGS. 24(*a*), 24(*b*), 24(*c*) and 24(*d*) are Figures explaining the function of the heating device in FIG. 23;

FIGS. 25(*a*) and 25(*b*) are Figures showing of an induction heating device;

FIG. 26 is a side view conceptually presenting a rolling apparatus equipped with a distributor and a reduction gear mechanism;

FIG. 27 is a schematic view presenting the reduction gear mechanism;

FIG. 28 is a figure explaining the method to change the inter-stand reduction ratio;

FIGS. 29(*a*) and 29(*b*) are Figures presenting how the inter-stand reduction ratios of plural roller-couple units are changed synchronously;

FIGS. 30(*a*) and 30(*b*) are Figures explaining how the wire twisting occurs;

FIGS. 31(*a*) and 31(*b*) are Figures presenting how the wire diameter is varied by changing in the roller-spacing.

DETAILED DESCRIPTION OF THE PREFERABLE EMBODIMENTS

Several embodiments of this invention will now be described with reference to drawings.

Figure 1:
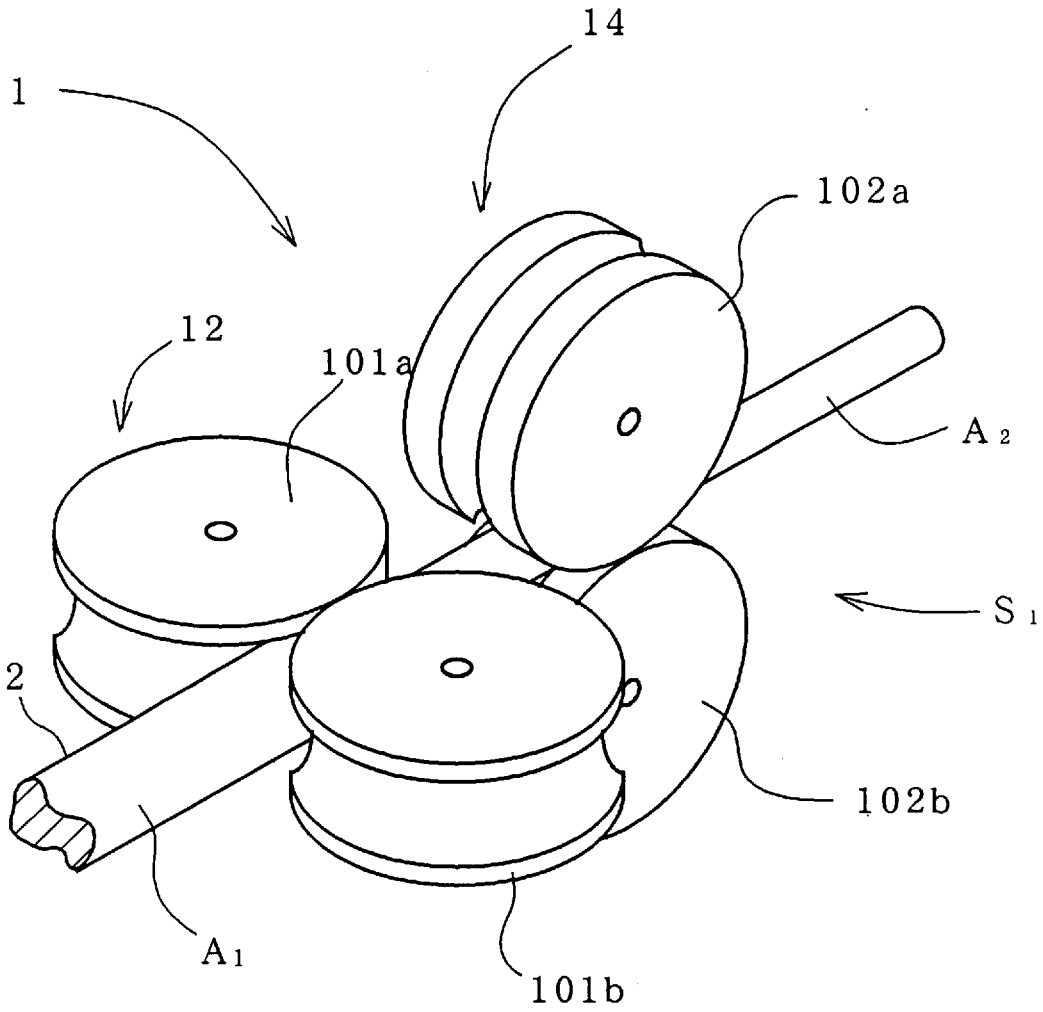
FIG. 1 is a perspective view presenting the main part of one embodiment of the apparatus of this invention.

FIG. 1 presents the main part of one embodiment of the apparatus regarding this invention for manufacturing wire by metal rolling process ("rolling apparatus", hereinafter). In the rolling apparatus 1, a first roller stand (horizontal stand) 12 comprising a first roller-couple 101*a*,101*b* is arranged on an unillustrated mill floor so that the roller axes is almost vertical to the mill floor, and a second roller stand (vertical stand) 14 comprising a second roller-couple 102*a*,102*b* is arranged adjacently to the first roller stand 12 on the downstream thereof along the feeding passage of work material A1 so that the roller axes is almost horizontal. These roller stands 12 and 14 construct a roller-couple unit S1. The angle between the roller axes of adjacent roller-couples 101*a*,101*b* and 102*a*,102*b* is almost 90°.

Figure 2A:
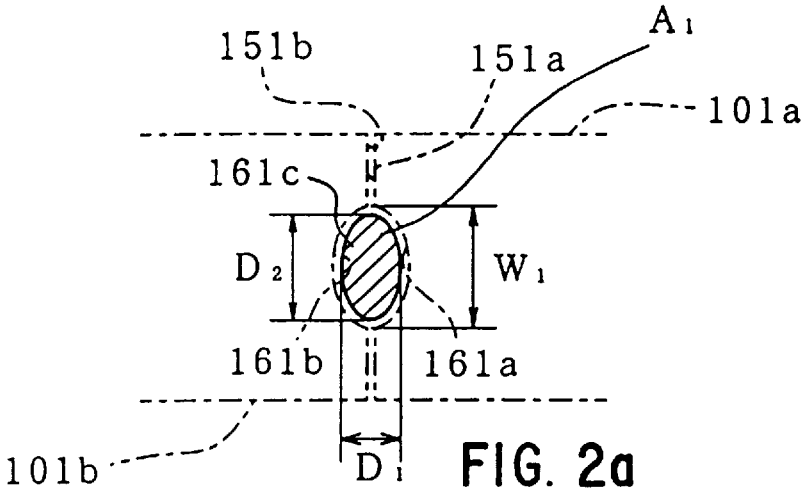
FIG. 2(*a*) is a schematic view presenting the cross sectional shape of the first sizing pass of the first roller couple.
Figure 2B:
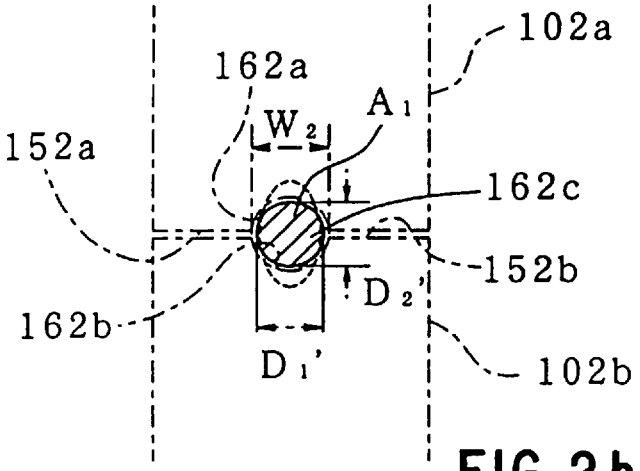
Figure 2C:
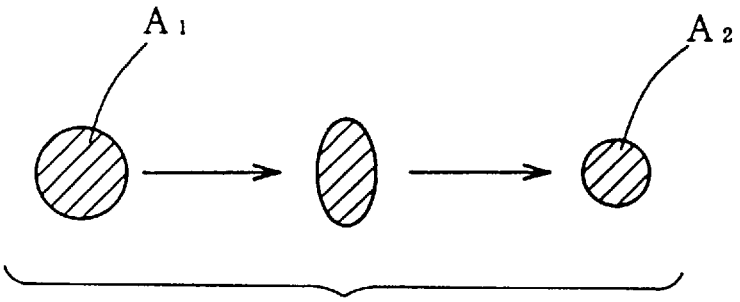

As shown in FIG. 2, the roller-couples 101*a*,101*b* and 102*a*,102*b* have rolling surfaces 151*a*,151*b* and 152*a*,152*b* on respective circumferences, and grooves 161*a*,161*b* and 162*a*,162*b* for determining the cross sectional shape of resulting wire are formed on respective rolling surfaces 151*a*,151*b* and 152*a*,152*b*. The width W1 of the grooves 161*a*,161*b* is less than 7 mm, and the width W2 of the grooves 162*a*,162*b* is less than 6 mm. As is shown in FIG. 2 (*a*), in the first roller-couple 101*a*,101*b*, an oval sizing pass 161*c* is formed as the combination of the grooves 161*a*, 161*b*, and in the second roller-couple 102*a*,102*b*, a circular sizing pass 162*c* is formed as the combination of the grooves 162*a*,162*b*.

Figure 3:
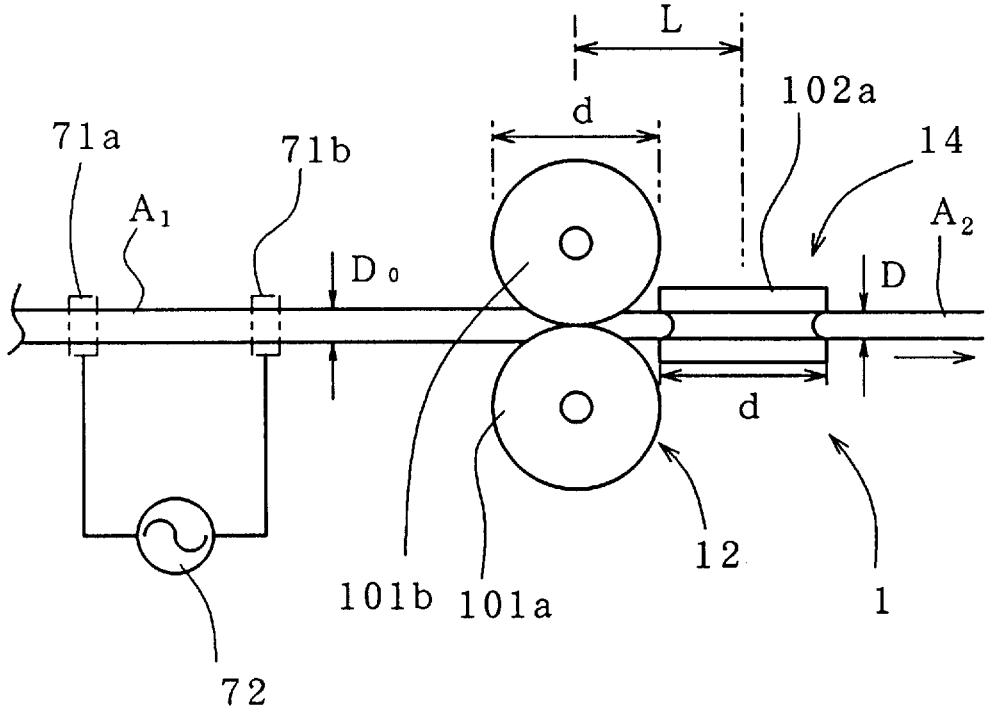
FIG. 3 is a top view presenting the main part of one embodiment of the apparatus of this invention.

As is shown in FIG. 3, the center distance L between the first and the second stands 12 and 14 is less than 50 mm, and the ratio of L/d, where d is the outer diameter of the rollers 101*a*,101*b* and 102*a*,102*b*, is less than 1.2.

Figure 4:
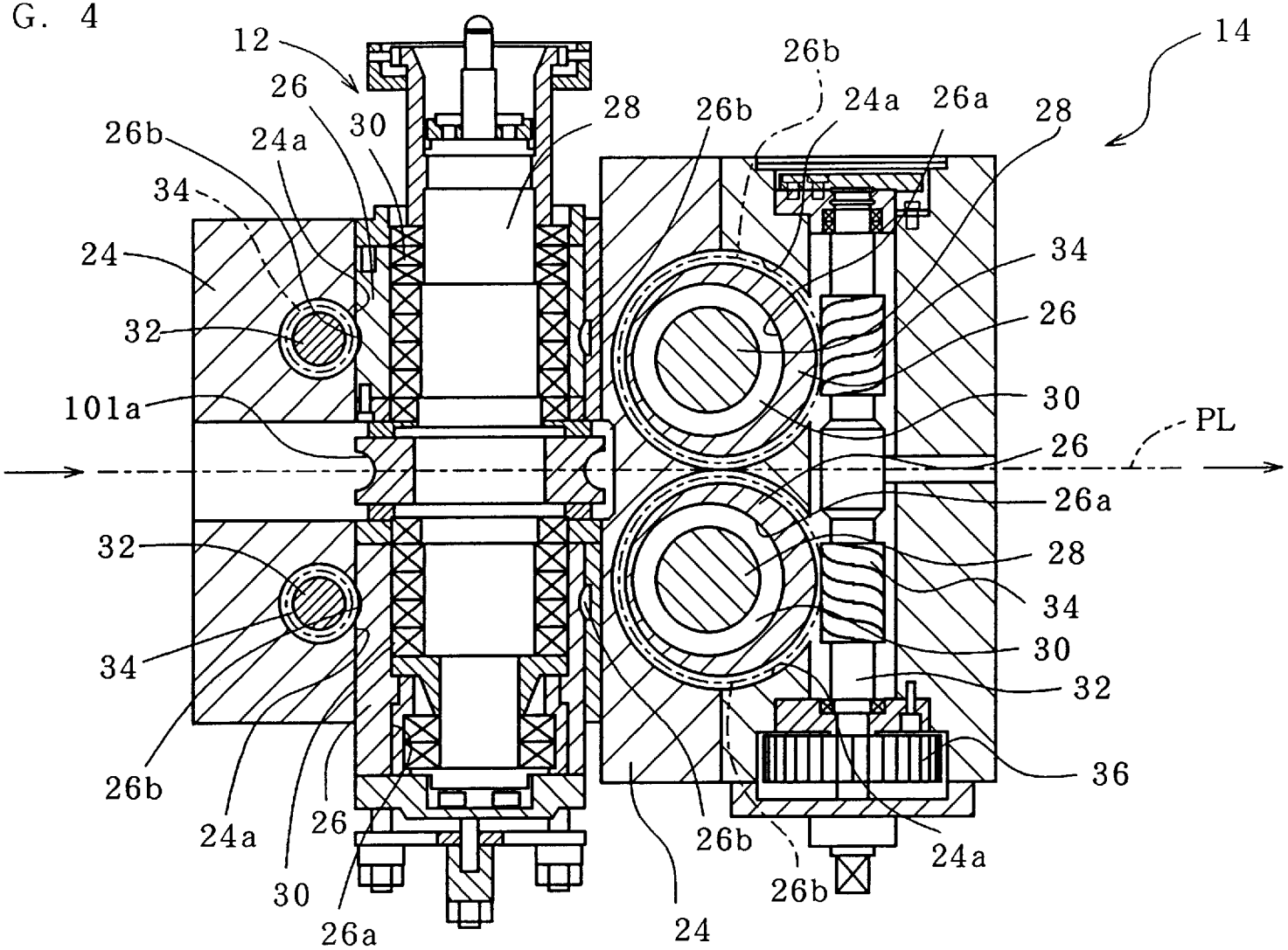
FIG. 4 is a cross sectional side view presenting one embodiment of the apparatus of this invention.

FIG. 4 is a cross sectional side view of the first and the second roller stands 12 and 14. These two roller stands 12 and 14 have almost the same configurations except for the direction of the roller axes. Therefore, the detailed description is presented only for the first roller stand 12, and the same portions or the members of the second roller stand 14 are indexed with the same numerals as those for the first one.

Figure 5A:
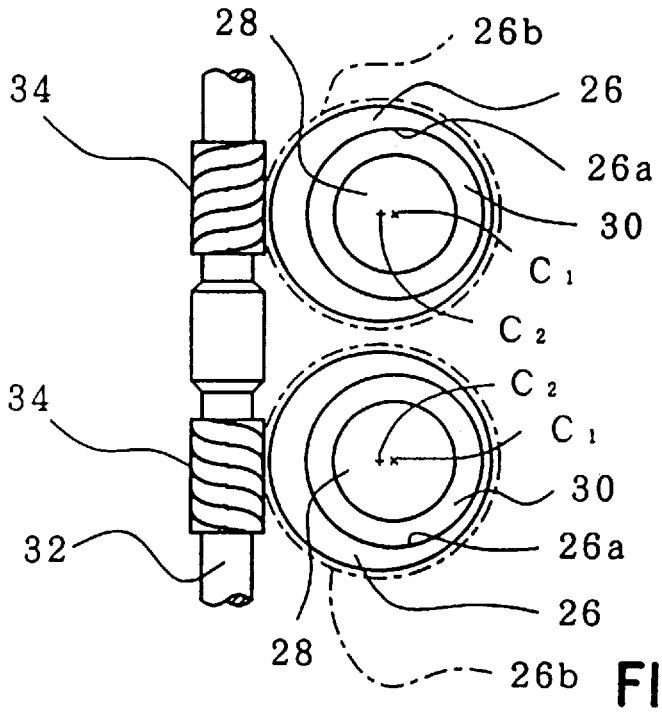
FIGS. 5(*a*) and 5(*b*) are schematic top views presenting the bearing rotation mechanism in FIG. 4.
Figure 5B:
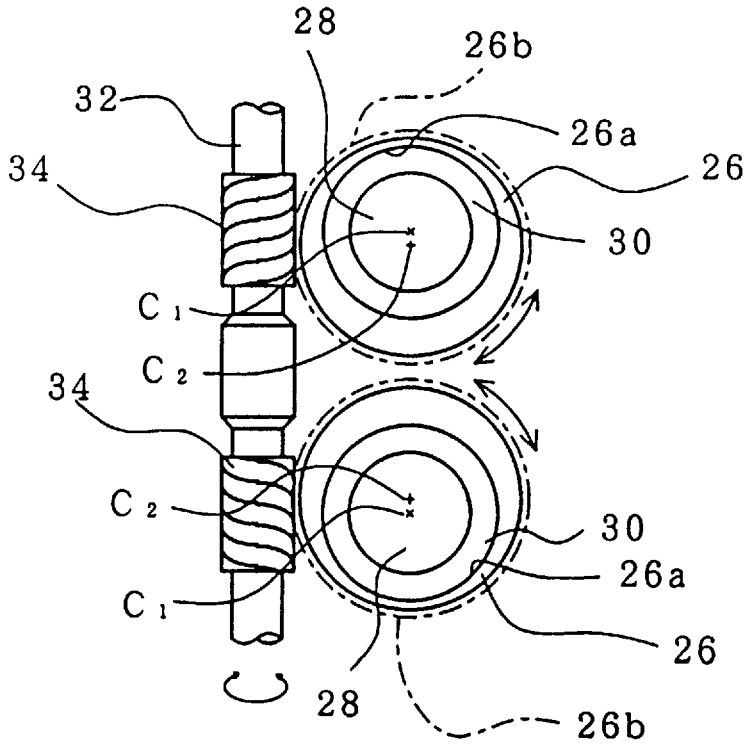
Figure 6:
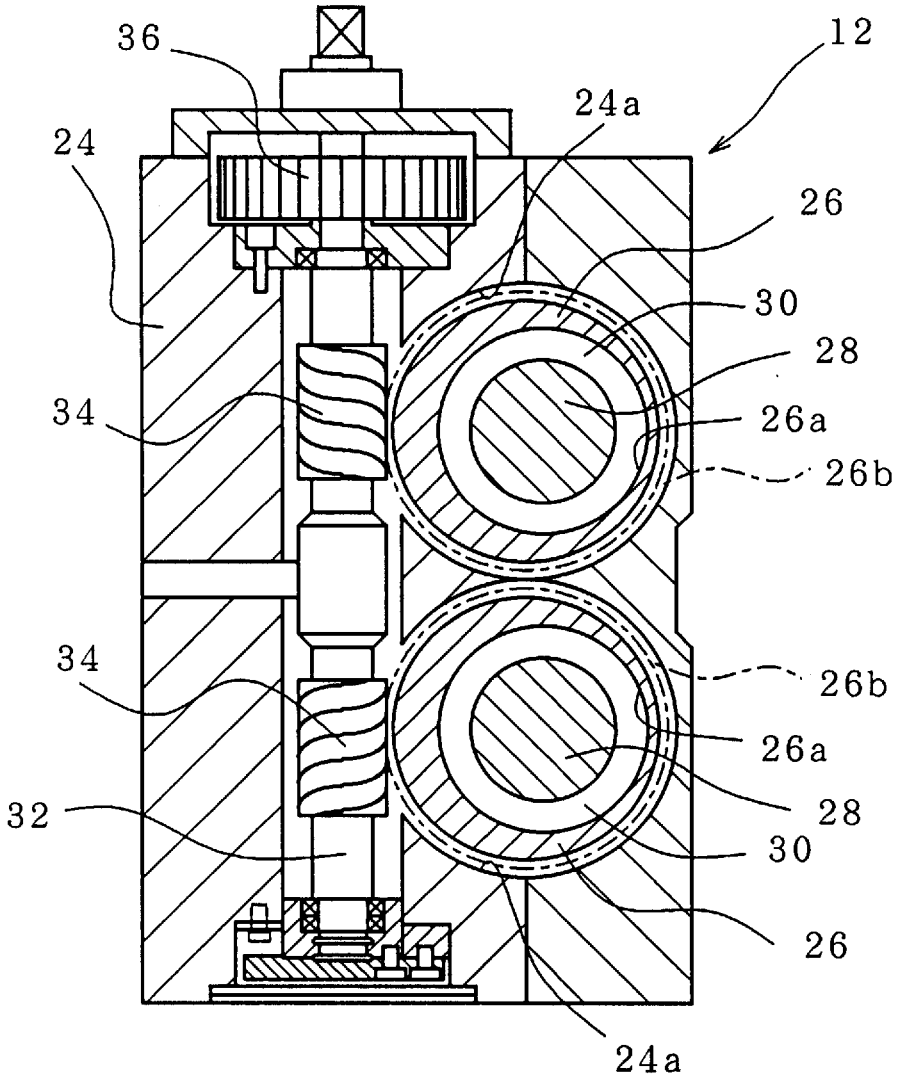
FIG. 6 is a cross sectional side view of the first roller stand.

In the first roller stand 12, a pair of bearing casings 24 are arranged on both sides of the feeding passage (or pass line) PL of the work material A1. Each bearing casing 24 has a bearing accomodating hole 24*a* formed along the direction intersecting with the pass line PL. Each bearing accomodating hole 24*a* rotatively accommodates a bearing main body 26 wherein a through hole 26*a* as a bearing hole is eccentrically formed. In these through hole 26*a*, both end portions of a roller shaft 28 are rotatively supported by a bearing 30, respectively. On the intermediary portion of the roller shaft 28, a roller 101*a* (or 101*b*: represented by 101*a*, hereinafter) is integrally mounted. As shown in FIG. 5 (*a*), the axis C1 of the roller shaft 28 is located deviating from the axis C2 of the bearing main body 26 at a designated distance. The axes C1 for rollers 101*a*,101*b* in opposite direction are to be displaced by the rotation of the corresponding bearing main bodies 26 according to the mechanism described later on.

As shown in FIG. 4, on the upstream of the roller shaft 28, a pair of worm rotating shaft 32 are arranged in a direction crossing over the roller shaft 28. The worm rotating shaft 32 is provided on each side with respect to the first roller-couple 101*a*,101*b* (FIG. 1), and as shown in FIG. 5, worms 34 are integrally mounted thereon corresponding to upper and lower bearing main bodies 26 and engage with the gear portions 26*b* formed on the circumferences of the corresponding bearing main bodies 26, respectively (see also FIG. 8). As shown in FIG. 5, the direction of threads of the two worms 34 on each worm rotating shaft 32 are opposite each other. On the other hand, as shown in FIG. 7, the threads of worms 34 corresponding to both end portions of the same roller shaft 28 are formed in the same direction.

Figure 7:
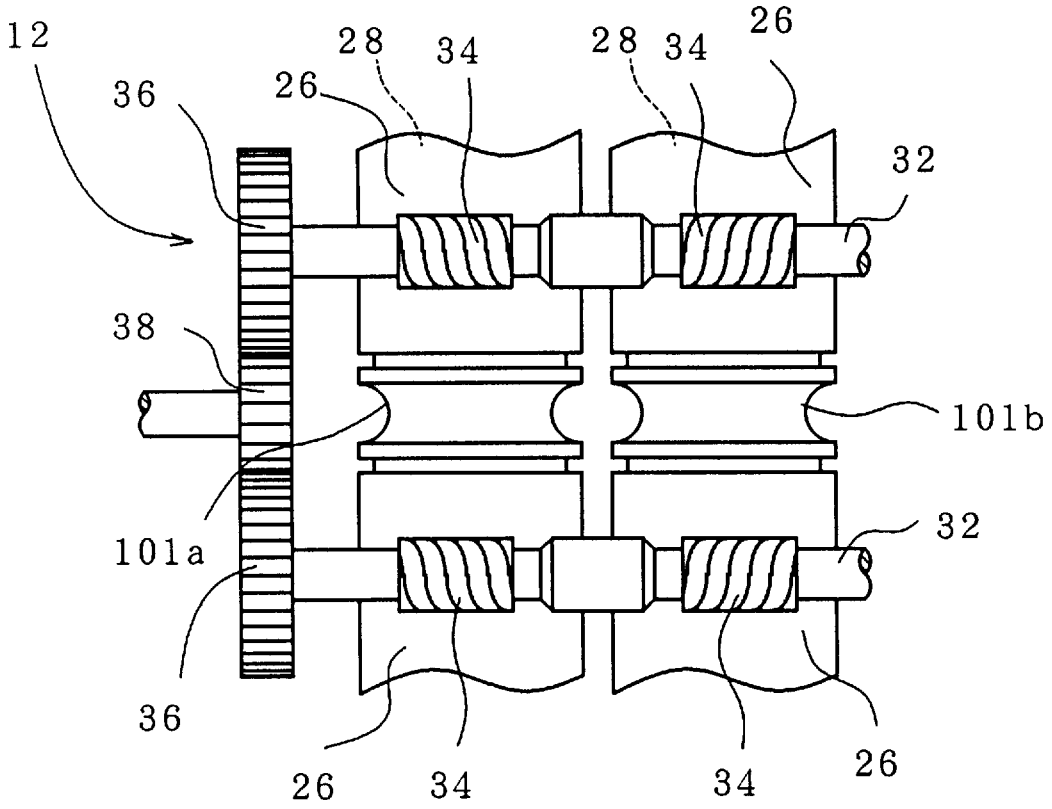
FIG. 7 is a front view presenting the arrangement of the bearing main body and the worm rotating shaft.
Figure 8:
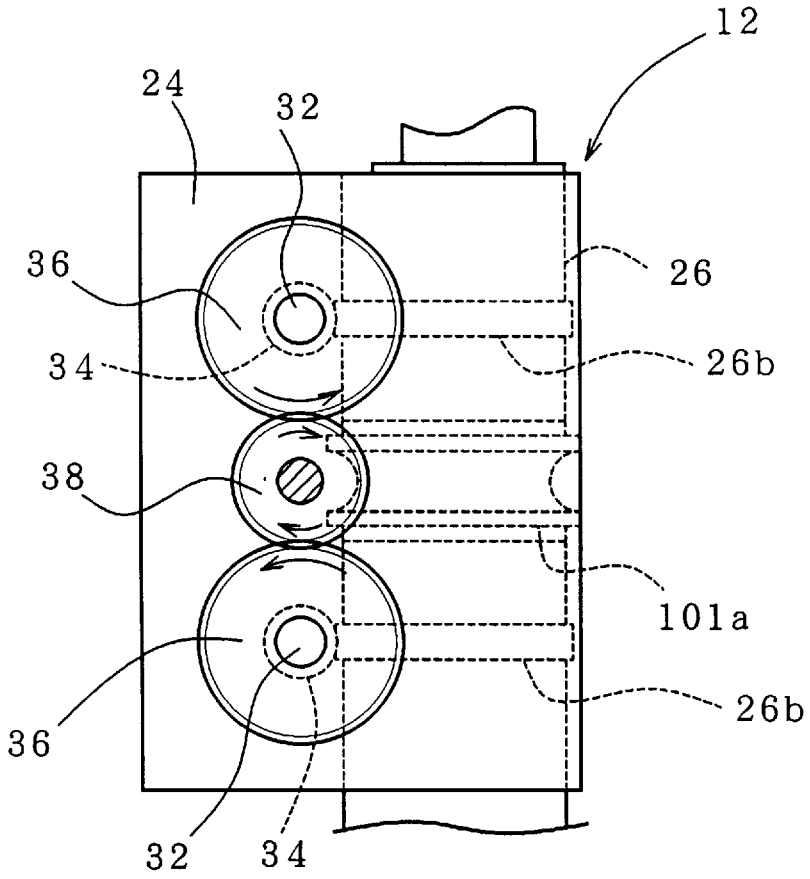
FIG. 8 is a schematic side view of FIG. 7.

As shown in FIG. 7 and FIG. 8, on the corresponding end portions of two worm rotating shafts 32,32, gears 36,36 are secured so as to rotate integrally with corresponding worm rotating shafts 32, respectively. These gears 36 engage with an adjusting gear 38 which is rotatively mounted on the bearing casing 24. The adjusting gear 38 is rotated by an unillustrated driving means, such as a motor, whereby said two worm rotating shafts 32,32 rotate simultaneously in the same direction. Thus, as shown in FIG. 5 (*b*), the bearing main bodies 26 rotate around the axis C2 through corresponding worms 34, and the upper and lower roller shafts 28,28 move to or form each other, whereby the clearance between the roller shafts, 28,28 i.e, the clearance between the rollers 101*a*,101*b* is adjusted.

As shown in FIG. 4, there is no worm rotating shaft 32 as a bearing rotating mechanism is located downstream of the bearing casing 24, where the roller shaft 28 is eccentrically arranged, so that the thickness of the first roller stand 12 is decreased on that side. The thickness of the second roller stand 14 located upstream of the bearing casing 24 is also decreased due to the same reason. Since these two stands 12 and 14 are adjacently arranged so that the small thickness sides thereof are facing to each other, the center distance L between the first and the second roller-couples 101*a*,101*b* and 102*a*,102*b* becomes short.

Now, the operation of the rolling apparatus 1 is going to be explained in the following. As is shown in FIG. 1, the work material A1 having a circular cross section with a diameter D0 is introduced to the first roller stand 12 and rolled in the sizing pass 161*c* so that the shape of the cross section becomes oval as shown in FIG. 2 (*a*). After that, as shown in FIG. 2 (*b*), work material A1 is fed to the second roller stand 14 (FIG. 1) and rolled in the sizing pass 162*c* so that the shape of the cross section becomes circular. Thus, the cross section of the work material A1 successively decreases with alternately varying the shape thereof as circular—oval—circular as shown in FIG. 2 (*c*). The work material A1 is rolled in the first roller stand 12 so that the cross sectional dimension thereof in a direction of rolling reduction, D1 (corresponding to the short axis of oval), becomes shorter than that in a direction perpendicular to the direction of rolling reduction, D2 (corresponding to the long axis of oval). Then, in the second roller stand 14, since the direction of rolling-compression is changed by 90°, the work material A1 is rolled so that the ratio of the dimensions, D2/D1, is decreased (i.e., (D2/D1)>(D2'/D1'), where D1' and D2' are corresponding dimensions after rolling).

Since the first and the second roller stand 12 and 14 are adjacently arranged so that the center distance L between the first and second roller-couples 101*a*,101*b* and 102*a*,102*b* is less than 50 mm as shown in FIG. 3, the work material A1 from the first stand 12 can be precisely supplied to the second one 14 causing no twisting of itself without any aid of roller guides. The final diameter of produced wire W2 is preferably set in a range of 1.30 –5.40 mm for achieving high dimensional accuracy of the wire and for suppressing the frequency of the faults in the resulting wire, whereby the superiority in wire productivity to the conventional method such as the metal drawing process becomes very significant. For this purpose, the width W1 of the grooves 161*a*,161*b* (FIG. 2) is preferably set to be less than 7 mm, and the width W2 of the grooves 162*a*,162*b* is preferably set to be less than 6 mm.

Figure 9:
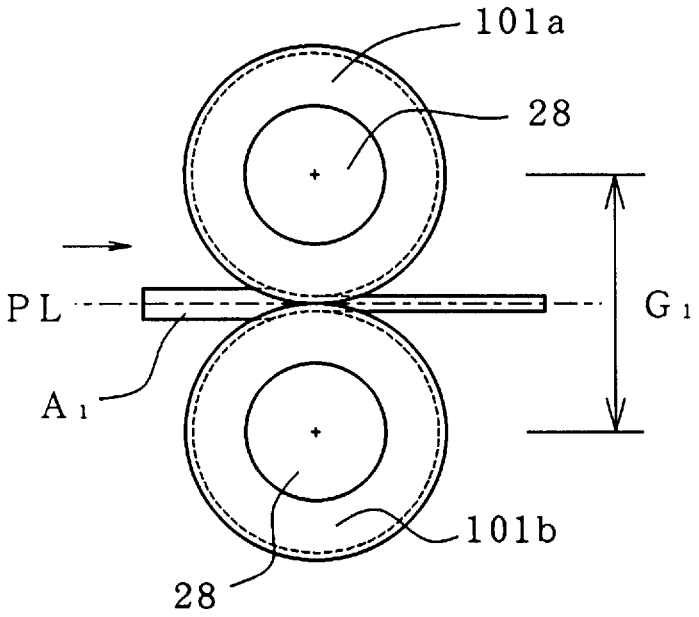
FIGS. 9(*a*) and 9(*b*) are schematic top views presenting the states of the first roller-couple for rolling wires with various diameters.
Figure 9:
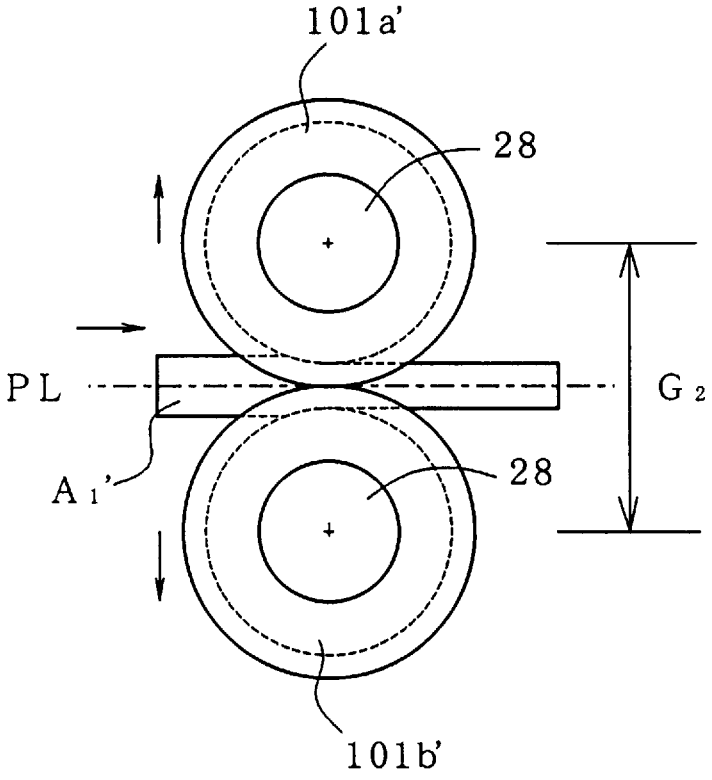

The roller spacing can be changed in such way as follows (explained according to an example for the first roller stand 12, representatively). As shown in FIG. 9, when the work material A1 is switched to that having a larger cross sectional dimension, A2, the roller-couple 101*a*,101*b* should be replaced with the ones 101*a*',101*b*' with wider width of grooves 161*a*,161*b* and larger diameter. The distance between the shaft axes is also changed from G1 to G2. According to the construction described above, necessary adjustment can be performed in a very easy operation. That is to say, as shown in FIG. 7, the worm rotating shafts 32,32 are rotated in the same direction forwardly or reversely by the driving means through the gears 36 and the adjusting gear 38. Then, as shown in FIG. 5 (*a*) and (*b*), the bearing main bodies 26 rotate around the axis C2, the upper and the lower roller shafts 28,28 moves to or from each other according to the rotation direction of the bearing main bodies 26, whereby the roller clearance is adjusted. The roller-couples can be driven independently by corresponding motors for the adjustment of said clearance.

Figure 10A:
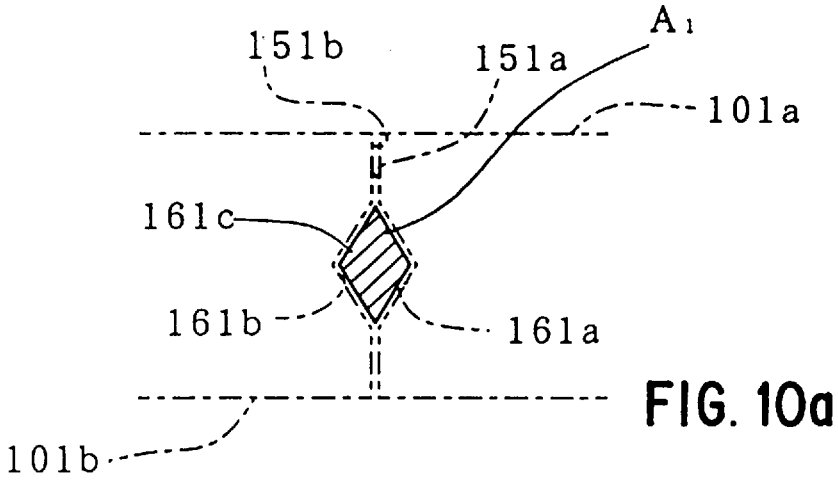
FIGS. 10(*a*), 10(*b*) and 10(*c*) are schematic views presenting several modifications of the shape of the sizing pass.
Figure 10B:
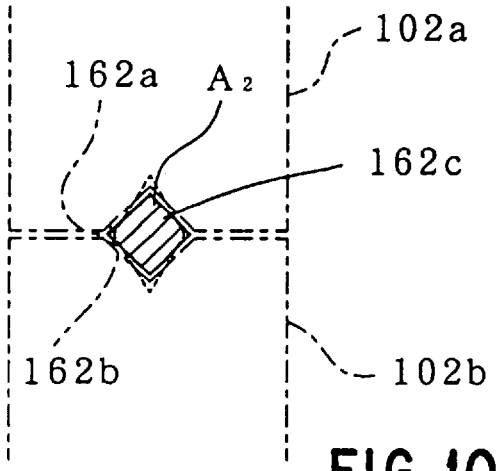
Figure 10C:
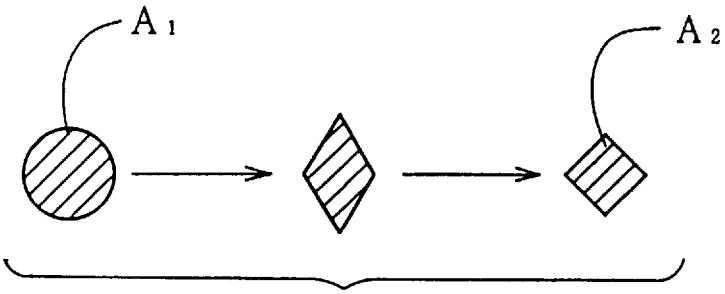
Figure 11:
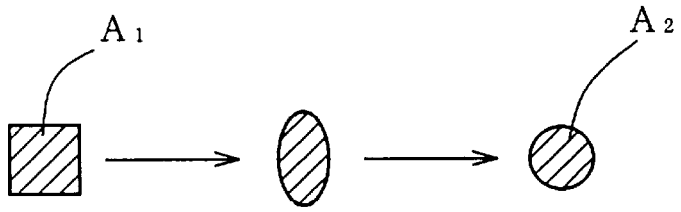
FIG. 11 is a schematic view presenting other example of the change in the cross sectional profile of work material.

The combination of the sizing passes 161*c* and 162*c* is not limited to the oval-circular one. FIG. 10 presents an example of combination of rhombic and square sizing passes 161*c* and 162*c*. The work material is to be rolled into wire A2 having a square cross section. Furthermore, according to the choice of combination of sizing passes 161*c* and 162*c* presented in FIG. 11, the work material A2 can be rolled successively changing the cross section as square-oval-circular, and so on.

Figure 12:
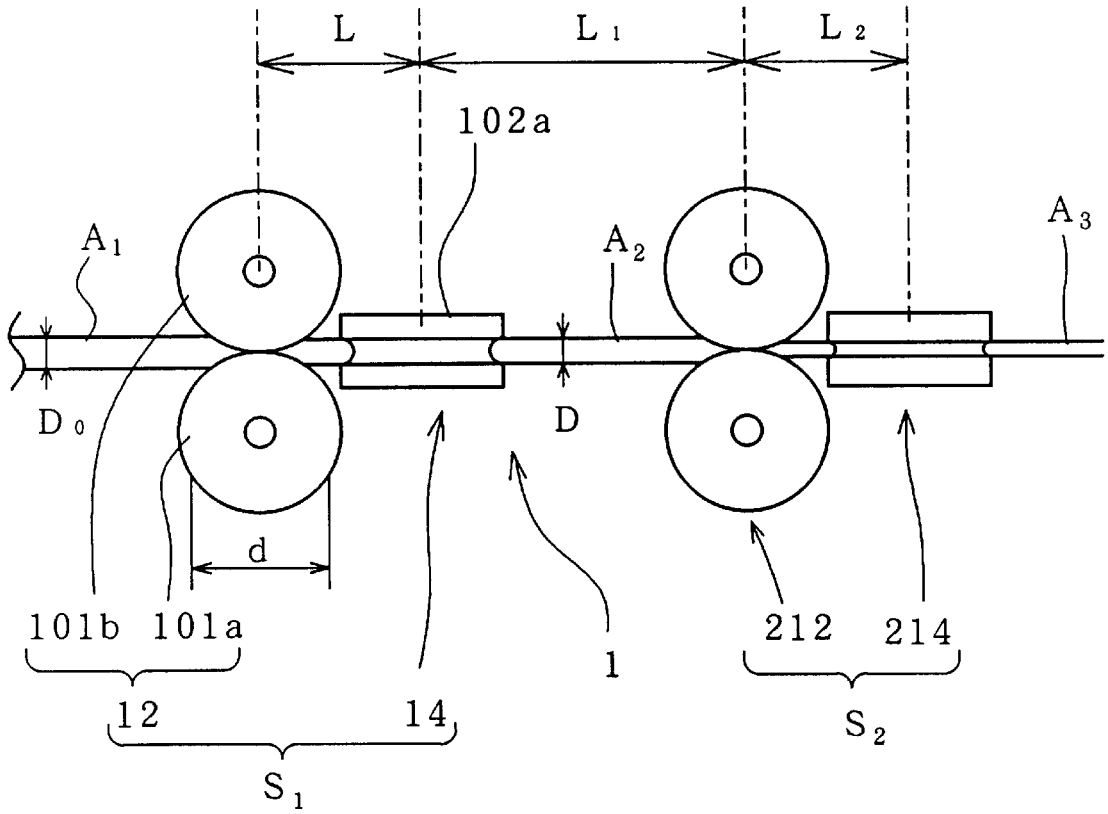
FIG. 12 is a top view conceptually presenting an apparatus comprising a plurality of roller-couple units.

As shown in FIG. 12, the wire A2 rolled in the first roller-couple unit S1 can be further rolled into wire A3 having a smaller diameter by using another similarly constructed roller-couple unit S2 which comprises roller stands 212 and 214 having smaller sizing passes and is arranged adjacently to the first one S1 on the downstream thereof. For performing further many steps of successive rolling, more than three roller-couple units can be arranged in a series along the work feeding direction. In this case, the plural roller-couples are alternately arranged so that the angle between the roller axes of adjacent roller-couples is almost 90°.

Figure 13:
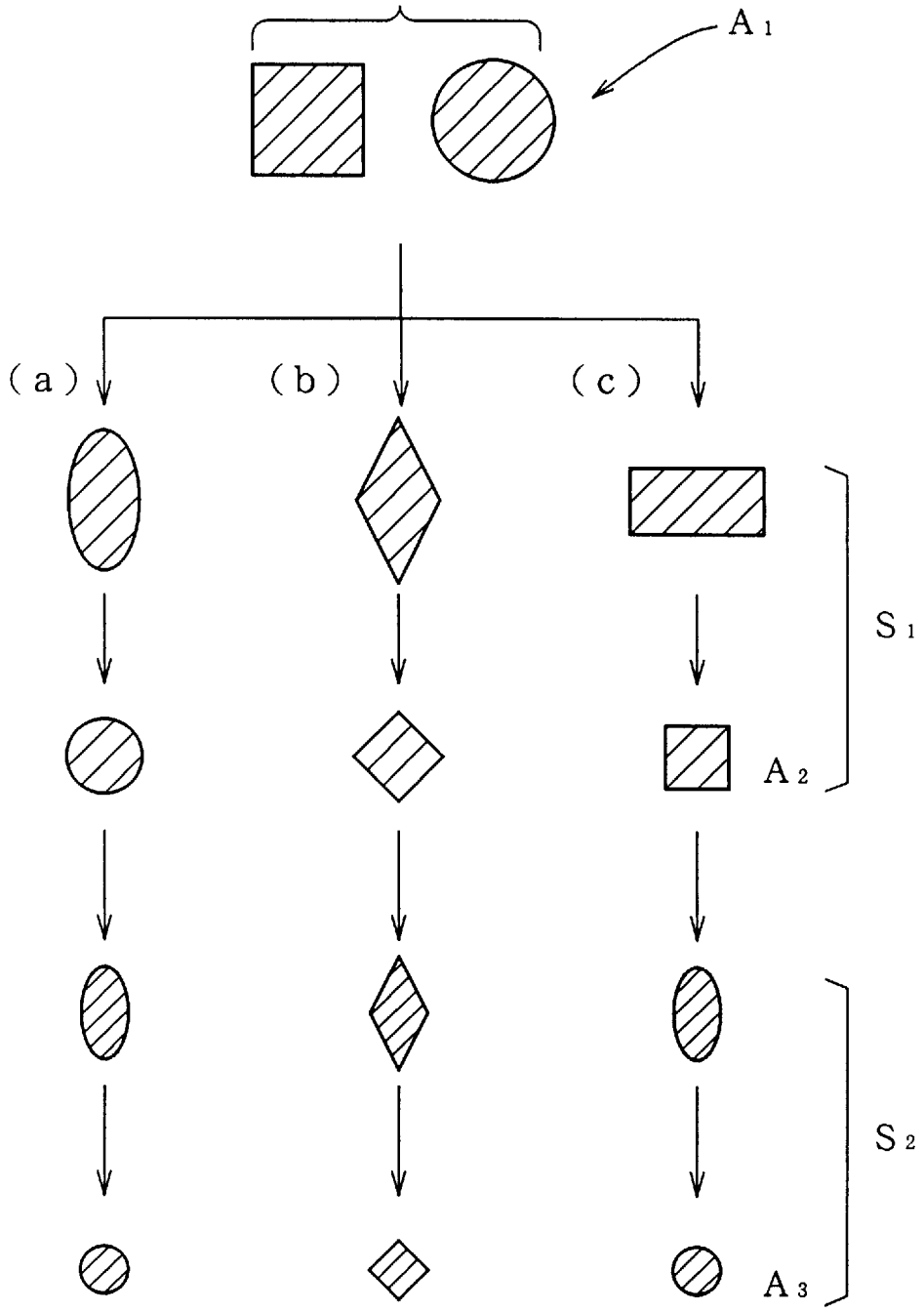
FIG. 13 is a schematic view presenting several examples of the change in the cross sectional profile of work material according to a successive rolling by the plural roller-couple units.

In the case of using a plurality of roller-couple units, although the same combination of the sizing passes can be used for all roller-couple units, different combinations can be also used for each roller-couple unit. FIG. 13 presents several example of using two roller-couple units. FIG. 13 (*a*) and (*b*) are examples of using the same combinations for each units, such as oval-circular or rhombic-rhombic. FIG. 13 (*c*) presents an example of using different combinations such as rectangular-square for the upstream unit S1 and oval-circular for the downstream unit S2.

Figure 14:
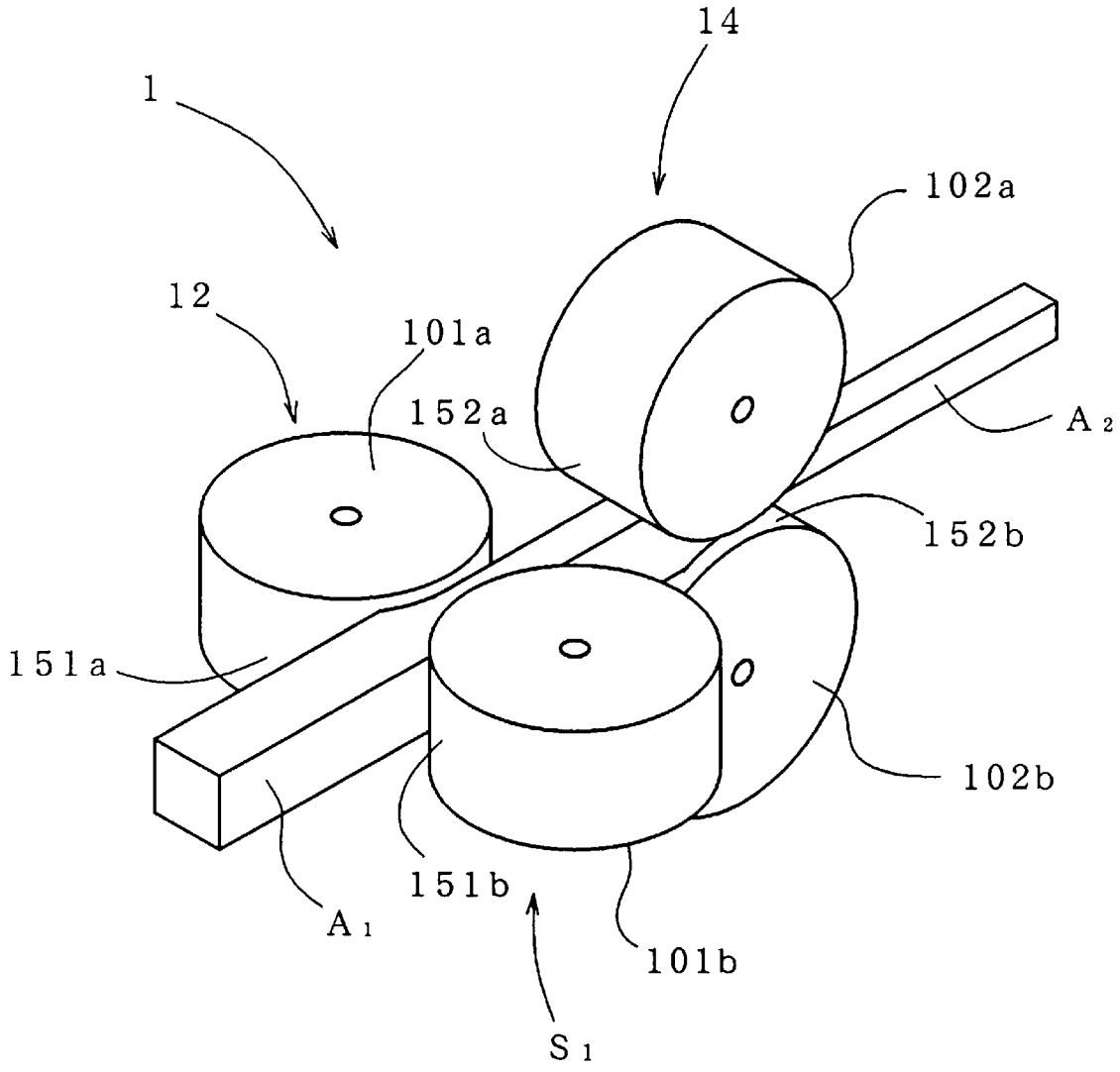
FIG. 14 is a perspective view presenting the main part of an embodiment of the apparatus having flat rollers.

As is shown in FIG. 14, the wire may by produced by using first and second roller-couples 101*a*,101*b* and 102*a*, 102*b* which have flat rolling surfaces 151*a*,151*b* and 152*a*, 152*b* without grooves, respectively. In this case, as shown in FIG. 15, the clearance W1 between two rollers 101*a*,101*b* (i.e., the clearance between the rolling surfaces 151*a*,151*b*) is less than 7 mm, and the clearance W2 between two rollers 102*a*,102*b* (i.e., the clearance between the rolling surfaces 152*a*,152*b*) less than 6 mm.

Figure 15A:
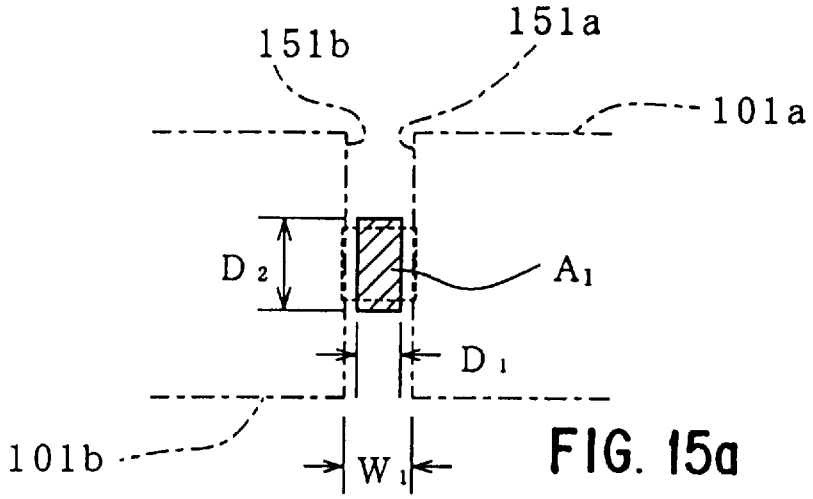
FIGS. 15(*a*), 15(*b*) and 15(*c*) are Figures explaining the function of the first and second roller-couples in FIG. 14.
Figure 15B:
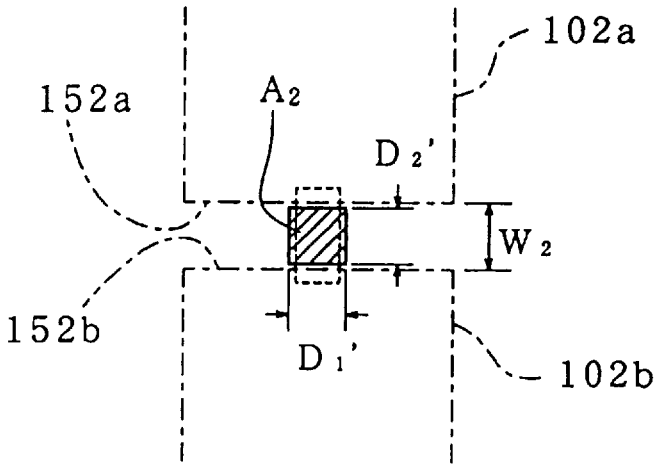
Figure 15C:
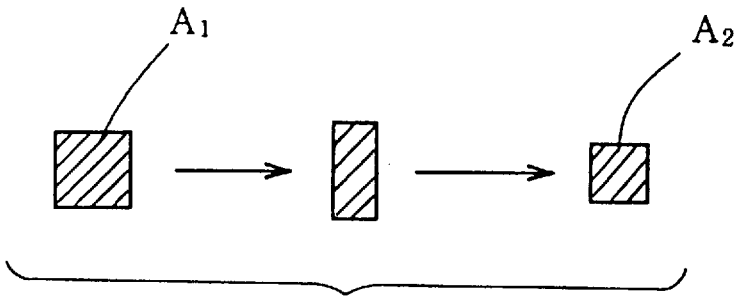

In such construction of the apparatus, as shown in FIG. 15, the work material A1 is deformed to be a rectangular cross sectional one due to the compression between the rollers 101*a*,101*b*, and then is deformed between the rollers 102*a*,102*b* in a direction perpendicular to the first compression, thereby running out therefrom as a wire A2. As shown in FIG. 15 (*c*), the cross section of the work material A1 successively decreases with alternately varying the shape thereof as square—rectangular—square.

Figure 16:
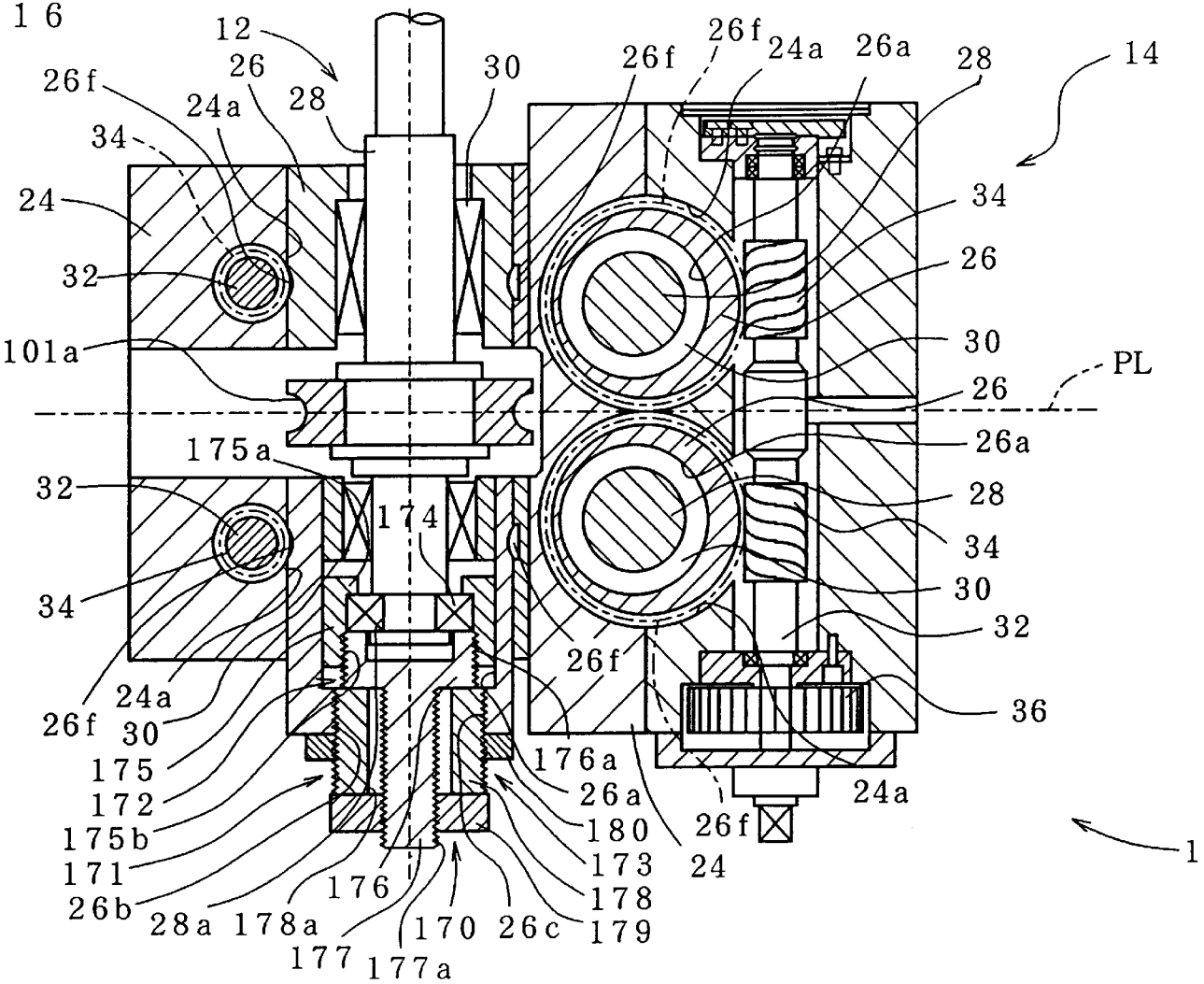
FIG. 16 is a cross sectional side view of an apparatus equipped with a roller thrust adjusting mechanism.

An example of roller thrust adjusting mechanism will now be explained according to an example for roller 101*a* in FIG. 4. As shown in FIG. 16, the roller thrust adjusting mechanism 170 is constructed so as to comprise a fixed bearing portion (or a bearing) 30 which holds the roller shaft 28 rotatively and movably in its thrust direction, and a roller sliding mechanism 171 which is connected to one end portion of the roller shaft 28 and slides the roller shaft 28 to the bearing portion 30 in the thrust direction.

The roller sliding 171 mechanism comprises a shaft holder 172 to which the end portion of the roller shaft 28 is connected and which is movable integrally with the roller shaft 28 in the thrust direction, and an adjusting screw mechanism 173 which is connected to the shaft holder 172 and moves the shaft holder 172 in the thrust direction according to its screwing or unscrewing operation. The shaft holder 172 comprises a bearing 174, a sleeve 175, a holder main body 176, and so on. The bearing 174 is engaged with an annular groove 28*a* which is formed on the circumferential surface of one end portion of the roller shaft 28, and held by the sleeve 175 from outside which is provided slidable in the through hole 26*a* in its axial direction. Furthermore, annular rib 175*a* is formed protruding from the inner surface of the sleeve 175 on one end portion thereof and engages with the edge portion of the end surface of the bearing 174.

On the inner surface of the sleeve 175, a female threaded portion 175*b* is formed in opposition to the rib 175*a* with respect to the bearing 174. The holder main body 176 connected with the sleeve 175 from inside by means of the male threaded portion 176*a* which is formed on its circumferential surface and is screwed in said female threaded portion 175*b*. The bearing 174 is clumped between the rib 175*a* and the holder main body 176, thereby prevented from loosening in the thrust direction. The roller shaft 28 is slidable integrally with the shaft holder 172 comprising said portion and members 174–176 so as to be able to rotate by means of bearing 174.

A shaft-like protruding portion 177 is integrally formed on the end surface of the holder main body 176. This portion 177 extends along the axial direction of the roller shaft 28 in the through hole 26*a*, and the end portion thereof protrudes outside from the corresponding opening 26*b* of the through hole 26*a*. On the inner side of the through hole 26*a*, a female threaded portion 26*c* is formed on the end portion thereof leading to the opening 26*b*. A male screw member 178 is screwed on the female threaded portion 26*c* in a position corresponding to the intermediary part of the shaft-like protruding portion 177. The male screw member 178 has a through hole 178*a* wherein the shaft-like protruding portion 177 is extending in its axial direction, and is rotatably held around the portion 177. These female threaded portion 26*c* and the male screw member 178 constructs said adjusting screw mechanism 173.

The end surface of the male screw member 178 is contacting with the edge portion of corresponding end surface of the holder main body 176. On the other hand, the opposite end surface of the male screw member 178 is contacting with a nut 179 screwed on the male thread 177*a* formed on the outer surface of the protruding portion 177. These holder main body 176 and nut 179 function as a stopper for preventing the male screw member 178 from its relative movement to the shaft-like protruding portion 177 in the axial direction thereof. On the other hand, a lock nut 180 is screwed on the male screw member 178 and secured toward the bearing main body 26 for preventing the male screw member 178 from loosening. Furthermore, the nut 179 also functions as a lock nut for the male screw member 178.

The adjusting screw mechanism 173 is operated in the following manner for the thrust adjustment of the roller 101*a*. As shown in FIG. 17 (*a*), for the roller needed to be adjusted (represented by the roller 101*a*), the lock nut 180 is loosened, and subsequently the nut 179 is loosened so as not to occur an excess loosening thereof in the axial direction. In the case of moving the roller 101*a* toward the adjusting screw mechanism 173 (right on the figure), the male screw member 178 is rotated so as to move to right on the figure as shown in FIG. 17 (*b*). The male screw member 178 urges the shaft holder 172 and the roller shaft 28 through the nut 179, and moves them integrally to the right. When the new position of the roller 101*a* is determined, the lock nut 180 and the nut 179 are successively secured in this order, and the operation of the adjustment is to be finished. On the other hand, in the case of moving the roller 101*a* leaving from the adjusting screw mechanism 173 (left on the figure), the male screw member 178 is reversely rotated. As shown in FIG. 18, the male screw member 178 urges the shaft holder 172 and the roller shaft 28 through the holder main body 176, and moves them integrally to the left. When the new position of the roller 101*a* is determined, the lock nut 180 and the nut 179 are successively secured in this order.

In the case of using work-difficult materials, such as high speed tool steels, stainless steels, high alloy steel or Ti—Ni based shape memory alloys, it is advantageous to elevate the rolling temperature for decreasing the deformation resistance, whereby improving the productivity of wire. Therefore, the work material can be heated before rolling in the first roller stand 12. As is shown in FIG. 3, the work material can be heated by a heating device which comprises electrodes 71*a*,71*b* contacting with the work material A1 allowing the feeding thereof. Electric current is sent into the work material A1 from the electric power unit 72 through the electrode 71*a*,71*b*. The work material is to be heated by its own resistance-heat generation.

FIG. 20 presents one of preferable embodiments of hot-rolling line 401 for the wire production. This line 401 comprises an uncoiler 2 for drawing the work material A1, such as of a high speed tool steel or a stainless steel, from the coil thereof. The work material A1 drawn off by the uncoiler 2 is fed to a scale removing device 4 via a roller leveling device 3.

The scale-removing device 4 is constructed as a shot-blasting device. As shown in FIG. 21, this device 4 removes the scale from the work material A1 by blasting a flow of abrasive particles 114*b* from rotary nozzles 114*a* onto the surface of the work material A1. The abrasive particles 114*b* is collected at the bottom of the housing 114*c*, elevated by a bucket conveyor 114*d*, and then mixed with a gas flow from an unillustrated source, such as a blower, and then supplied to the rotary nozzles 114*a* again.

As shown in FIG. 20, the work material A1 after the removal of the scale is fed to the heating device 5. As shown in FIG. 22, the heating device 5 comprises first and second water cooled roller electrodes 51,52 and 53,54 which contact with the work material A1 and send electric current thereinto for the resistance-heating thereof, corresponding first and second air cylinders 55,56 and 57,58 as urging mechanism which urges said roller electrodes 51,52 and 53,54 against the work material A1, and an electric power unit 59 (FIG. 20) as a source of said electric current for heating. On the circumferential surfaces of roller electrode 51–54, grooves 51*a*–54*a* are formed, respectively, for guiding the transportation of the work material A1. The cross sections of grooves 51*a*–54*a* are formed in a shape corresponding to the shape of the work material A1, for example in a semicircular shape for a work material A1 having circular cross section.

As is shown in FIG. 20, the work material A1 heated by the heating device 5 is rolled by the rolling mill 6 (or the rolling apparatus), cooled in a water-cooling device 7, and then wound in a coil by a coiler 8. In the rolling mill 6, a plurality of aforementioned roller-couple units S are arranged along the direction of material feeding. The distance K between the heating device 5 and the rolling mill 6 is set to be less than 4 m, where K is defined as the distance from the second roller electrodes 53,54 and the entrance of the first roller-couple unit S.

Now, the operation of the hot rolling line 40 is going to be explained in the following. After leaving the roller levering device 3, the work material A1 is removed the scale in the shot-blasting device 4, and resistance-heated between the first and the second roller electrodes 51,52 and 53,54 to a designated temperature. The material temperature can be controlled by the adjustment of the electric current between the electrodes 51,52 and 53,54.

Since the scale is preliminarily removed from the surface of the work material A1 by using the shot-blasting device 4, the contact between the work material A1 and the electrodes 51–54 becomes more reliable, whereby spark generation is suppressed therebetween. Furthermore, since the grooves 51*a*–54*a* is formed corresponding to the cross sectional shape of the work material A1, the spark generation due to imperfect contact is prevented more effectively. When the cross section of the work material A1 is circular with a diameter of D0, the radius R of the semicircular cross section of the grooves 51*a*–54*a* is preferably in the range of $1.05\times(D0/2)\leqq R\leqq 5.0\times(D0/2)$ for preventing the spark generation.

When the work material A1 is heated over 1000° C., the deformation resistance of the material becomes considerably low, so that the urging pressure from the second roller electrodes 53,54 is preferably set to be lower than that from the first roller electrodes 51,52 for preventing the work material A1 from undesirable deformation due to the friction from the electrodes, such as buckling. The urging pressure can be adjusted by changing the pressure of the air cylinders 55–58.

The heating device 5 can be constructed so that at least one of first and second electrodes 51,52 and 53,54 is provided movably in the transportation direction of the work material A1, whereby the interval between the electrodes 51,52 and 53,54 becomes variable during heating of at least one of the tip and the tale end portions of the work material A1. According to this construction, the material yield improves since insufficiently heated part is hardly formed in the tip or the tale end portion of the work material A1.

In the embodiment presented in FIG. 23, the rollers 51,52 and the rollers 53,54 are rotatively mounted on electrode holders 121 and 131, and driven by motors 122 and 132, respectively. The electrode holders 121 and 131 are reciprocated by air cylinders 123 and 133, respectively, in the feeding direction of the work material A1, or in the reverse direction thereof.

The work material A1 from the scale removing device 4 (FIG. 20) is fed to the heating device 5 at a rate v. As shown in FIG. 24, electric current is started to be supplied to the work material A1 when the tip end portion thereof is protruded from the second roller electrodes 53,54 by a length 11. As shown in FIG. 24 (*c*) through the state of (*b*), the air cylinder 133 (FIG. 23) retracts a rod 133*a* thereby moving the roller electrodes 53,54 along with the work material A1 at a rate v', and stops the retraction of the rod 133*a* when the interval between the electrodes 51,52 and 53,54 ("electrode interval', hereinafter) reaches to a value lo, which is sufficient for accomplishing a designated heating efficiency. Then, as shown in FIG. 24 (*d*), the electrode interval is fixed to 10, and the work material A1 is started to be resistance-heated being transported at the rate v. The tip portion of the work material A1 thus passes through the heating device 5, next the part of length 11 without being resistance-heated and following insufficiently heated part of length 12, i.e., 11+12 in total, are cut off by an unillustrated cutting device, and then the rest of the work material is supplied to the rolling mill 6.

On the other hand, when the length of the rest of the work material A1 becomes said 11+12, the air cylinder 123 starts to move the first roller electrodes 51,52 in the direction of work feeding at the rate v', and when the electrode interval reaches to 12, the cylinder 123 stops moving electrodes 51,52. Then, the electric current supply to the work material is interrupted, and the tale end portion of the work material A1 with a length 11+12 is cut off by a cutting device. Although the cutting length of respective tip and tale portions of the work material A1 is 10+11 if the electrode interval is fixed, the cutting length becomes 11+12 which is much shorter than the aforementioned one according to the construction described above whereby improving the yield of the work material A1 improves.

Instead of resistance-heating device, the work material A1 can be heated by means of an induction heating device. In this case, the scale removing device 4 and resistance-heating device 5 in FIG. 20 is substituted with an induction heating device 44 as shown in FIG. 25. The induction heating device 44 is formed in a tunnel-like configuration having an entrance 44*a* and an exit 44*b*, and comprises an induction heating coil 44*c*. The work material A1 entered therein from the entrance 44*a* is continuously heated by the induction heating coil 44*c* and runs out from the exit 44*b*. In this case, if the distance from the exit 44*b* to the rolling mill 6 is set to be less than 4 m, the cooling of the work material A1 can be effectively suppressed.

Now, an example of rolling apparatus whose roller-couples are driven by a common driving means will be conceptually described in the following. As shown in FIG. 26, the roller couples 101,102 of the unit S1 and the roller-couples 201,202 of the stand S2 is driven by a motor 252 as said common driving means through a distributor 250 and reduction gear mechanisms 253–256 each of which corresponds to each said roller-couple. The rotation of the motor 252 is reduced at each reduction gear mechanism 253–256 according to a designated reduction ratio and transmitted to corresponding roller couple 101,102,201,202 through the distributor 250.

FIG. 27 schematically presents the reduction gear mechanisms 253,254 for the upstream roller stand S1. The reduction gear mechanism 253 comprises plural gears J1–J3 (tooth numbers are N1–N3, respectively) which are secured on a driving shaft 300 driven by the motor 252, and plural gears K1–K3 (tooth numbers are M1–M3, respectively) which are secured on a transmitting shaft 301 for the roller-couple 101 and engage directly or indirectly through other gears with said gears J1–J3, respectively. According to a relative sliding between the driving shaft 300 and the transmitting shaft 301, one of the gears K1–K3 is to be engages with corresponding one of the gears J1–J3. The rotation of the motor 252 is thus reduced according to the reduction gear ratio Q1 which is determined as the tooth number ratio of the engaging gears (N1/M1 in FIG. 27), whereby the rotation rate R1 of the roller-couple 101 is to be determined to a corresponding value.

The reduction gear mechanism 254 comprises plural gears J4–J6 (tooth numbers are N4–N6, respectively) which are secured on a driving shaft 302 driven by the motor 252, and plural gears K4–K6 (tooth numbers are M4–M6, respectively) which are secured on a transmitting shaft 303 for the roller-couple 102 and engage directly or indirectly through other gears with said gears J4–J6, respectively. According to a relative sliding between the driving shaft 302 and transmitting shaft 303, one of the gears K4–K6 is to be engaged with corresponding one of the gears J4–J6. The rotation of the motor 252 is thus reduced according to the reduction gear ratio Q2 which is determined by the tooth number ratio of the engaging gears (N4/M4 in FIG. 27), whereby the rotation rate R2 of the roller-couple 102 is to be determined to a corresponding value.

As is shown in FIG. 29, the reduction mechanisms 255,256 has almost the same construction as those of said mechanisms 253,254, except for the reduction ratios. The former one 255 comprises gears J7–J9 on a driving shaft 304 and gears K7–K9 on a transmitting shaft 305, and the latter one 256 comprises gears J10–J12 on a driving shaft 306 and gears K10–K12 on a transmitting shaft 307.

For example, in the roller stands S1 and S2, the inter-stand reduction ratio Q1/Q2, i.e., the ratio of the roller rotation rate R1/R2 between the first and the second roller-couples 101 and 102 can be selected from designated plural values according to the torsional rigidity of the work material A1. The rotation rate is lower for the first roller-couple 101 than for the second one 102, so that Q1>Q2. Therefore, the inter-stand reduction ratio Q1/Q2 decreases with decreasing the rotation rate R2 of the second one 102. As shown in FIG. 28, the inter-stand reduction ratio Q1/Q2 can be changed, for example, by changing the reduction gear ratio Q2 for the second roller-couple 102 (N4/M4→N5/M5, for example) while fixing the reduction gear ratio Q1 for the first roller-couple 101 to a designated value (N1/M1, for example). Furthermore, as shown in FIG. 29, when the inter-stand reduction ratio Q1/Q2 of the roller-couple unit S1 is changed to Q1'/Q2', the ratio Q3/Q4 of the roller-couple unit S2 is synchronously changed to Q3'/Q4'.

Now, the operation of the rolling apparatus described above is going to be explained in the following. First of all, as shown in FIG. 29, the inter-stand reduction ratios are set to designated values for the first and the second roller-couple units S1 and S2, respectively. The probability of occurrence of wire twisting specifically depends upon the torsional rigidity of the work material. For example, as is shown in FIG. 30 (*a*), when the rolling reduction is increased for the first roller-couple 101 and 201 of the units S1 and S2, the work material A1 is deformed largely in the direction of the rolling compression. The resulting shape of the cross section of the work material A1 is to be elongated along the direction perpendicular to said compression, so that a significant twisting torque is applied upon the work material A1 when a secondary rolling is performed by the second roller-couples 102 and 202 in the direction crossing to the primary one.

Such twisting can be effectively suppressed by decreasing the rolling reduction for the work material having a low torsional rigidity as shown in FIG. 30 (*b*). In this case, the decrease in the rolling reduction at the first roller-couple causes a decrease in the reduction of area achieved thereat, so that the feeding rate of the work material A1 from the first roller-couple, i.e., that to the second roller-couple should be also decreased. Therefore, under an assumption that the rotation rate for the first roller couple is constant, the inter-stand reduction ratios Q1/Q2 and Q3/Q4 are to be set in a smaller values for a work material A1 having smaller torsional rigidity.

On the other hand, by using such construction of the rolling apparatus, the diameter of the wire produced can be easily changed. In the roller-couple units S1 and S2, the rolling reduction against the work material A1 varies according to the change in roller clearance. FIG. 31 presents an example for the unit S1, where the roller clearance of the roller-couple 101*a*,101*b* of the first stand 12 increases in the order of (a), (b), (c). The rolling reduction P1 for the working material A1 decreases in this order with decreasing the axial ratio of the oval cross section of the work material A1 after rolling. Therefore, the rolling reduction P2 in the second stand 14 for rolling the work material A1 in a circular cross section should be decreased in this order and the roller clearance of the roller-couple 102*a*,102*b* should be correspondingly increased in the order of (a), (b), (c), whereby the diameter D of the wire from the unit S1 increases in the order of (a), (b), (c). In other words, different size of wire diameter D is easily obtained by changing the rolling reduction of each roller-couple without changing the configuration of the sizing pass.

For example, when the rolling reduction P1 is increased for the first roller-couple 101 and 201 in the units S1 and S2, the work material A1 is deformed largely in the direction of the compression (or rolling) between the rollers, so that the transportation rate of the work material A1 from the first roller-couple, i.e., that to the second roller-couple should be also decreased. However, if the rolling reduction P1 (=(D0−D1)/D0 for the first stand; =(D2−D)/D2 for the second stand: i.e., dimensional changing ratio in the direction of rolling compression) is within 20%, or preferably within 10%, the rolling can be performed under a fixed rotation rate of second roller-couple. Furthermore, when the total rolling reduction achieved in each roller-couple units (i.e., sum of rolling reductions at the first and the second roller-couple) is within 10%, or preferably within 7%, the diameter D of the wire produced can be easily changed only by changing the roller clearance, i.e., by changing the rolling reduction at a fixed rotation rates of the first and the second roller-couples.

On the other hand, when the rolling reduction P1 exceeds 20%, the rotation rate of the second roller-couple can be increased with the increase in the feeding rate of the work material A1 for the second roller-couple for maintaining the rolling condition in a optimum state. Such change in the rotation rate of roller-couples can be performed by varying the inter-stand reduction ratios Q1/Q2 and Q3/Q4. For maintaining the optimum rolling condition, the configurations, i.e., the shapes and/or sizes of sizing passes of the first and the second roller-couples are preferably changed according to the value of said total rolling reduction against said work material A1. The total rolling reduction in each roller-couple unit can be varied so that resulting change in the reduction of area of said work material A1 is up to 40%.

What is claimed is:

1. A method for manufacturing wire by rolling work material successively with a first roller-couple and a second roller-couple which are arranged adjacently in a feeding direction of said work material and roll said work material in different directions each other, wherein said first and second roller-couples are arranged so that the ratio of L/D is less than 30, where L is a center distance between said first and second roller-couples, and D is a wire diameter obtained after the rolling by said second roller-couple;

and wherein said work material is rolled by said roller-couples so that reduction of area of said work material achieved by each roller-couples is 5–35%, and resulting wire diameter is less than 5.5 mm.

2. The method according to claim 1 wherein said first and second roller-couples are arranged alternatingly so that the angle between the rotation axes thereof is almost 90°;

wherein said first roller-couple rolls said work material so that the cross sectional dimension of said work material in a direction of rolling reduction, D1, becomes shorter than that in a direction perpendicular to said direction of rolling reduction, D2;

and wherein said second roller-couple rolls said work material so that the ratio of said dimensions, D2/D1, is decreased.

3. The method according to claim 1 wherein at least one of said first and second roller-couples comprises two rollers each of which has a groove on the circumferential surface thereof for forming a sizing pass, which determines the cross sectional shape of said wire.

4. The method according to claim 1 wherein the shape of said sizing pass formed by said grooves of said two rollers is oval for said first roller-couple and is circular for said second roller-couple.

5. The method according to claim 1 wherein a plurality of roller-couple units each of which comprises said first and second roller-couples are arranged in the feeding direction of said work material, and said work material is successively rolled by said roller-couple units.

6. The method according to claim 1 wherein the temperature of said work material is in the range of 400°–1300° C. when said work material is introduced to said first roller-couple.

7. A method for manufacturing wire by hot-rolling work material comprising the steps of:

continuously removing scale formed on work material in continuous feeding by using a scale-removing device arranged on the passage of said work feeding;

heating said work material after the removal of said scale by using a heating device which comprises an electrode contacting with said work material allowing the continuous feeding thereof and sending electric current into said work material through said electrode for resistance-heating of said work material;

rolling heated work material by using a rolling mill so that resulting diameter of wire is less than 5.5 mm;

wherein said rolling mill comprises a first roller-couple and a second roller-couple which are arranged adjacently in the feeding direction of said work material and successively roll said work material in different direction each other;

wherein said first and second roller-couples are arranged so that L/D is less than 30, where L is the center distance between said first and second roller-couples, and D is the wire diameter obtained after the rolling by said second roller-couple and, wherein said work material is rolled by said roller-couples so that reduction of area of said work material achieved by each roller-couples is 5–35%.

8. The method according to claim 7 wherein the distance between said heating device and said rolling mill is less than 4 m.

9. A method for manufacturing wire by hot-rolling work material comprising the steps of:

heating said work material in continuous feeding by using a heating device which is arranged on the passage of said feeding and comprises an induction heating coil for continuously heating said work material;

rolling heated work material by using a rolling mill so that the resulting diameter of the wire is less than 5.5 mm;

wherein said rolling mill comprises a first roller-couple and a second roller-couple which are arranged adjacently in the feeding direction of said work material and successively roll said work material in different directions from each other, and wherein said first and second roller-couples are arranged so that the ratio of L/D is less than 30, where L is the center distance between said first and second roller-couples, and D is the wire diameter obtained after rolling by said second roller-couple.

10. The method according to claim 9 wherein the distance between said heating device and said rolling mill is less than 4 m.

11. A method for manufacturing wire by rolling work material successively with a first roller-couple and a second roller couple which are arranged adjacently in a feeding direction of said work material and roll said work material in different directions from each other, wherein rolling reduction against said work material by each roller-couple is varied according to the variety of said work material, and the ratio, R1/R2, where R1 and R2 are roller-rotation rates of said first and second roller-couples, respectively, is adjusted according to said rolling reduction, wherein said first and second roller-couples are arranged so that the ratio of L/D is less than 30, where L is the center distance between said first and second roller-couples, and D is the wire diameter obtained after rolling by said second roller-couple; and wherein said work material is rolled by said roller-couples so that the reduction of area of said work material achieved by each roller-couples is 5–35%, and resulting wire diameter is less that 5.5 mm.

12. The method according to claim 11 wherein said rolling reduction and said ratio R1/R2 are varied according to the torsional rigidity of said work material.

13. A method for manufacturing wire by rolling work material successively with a first roller-couple and a second roller-couple which are arranged adjacently in a feeding direction of said work material an roll said work material in different directions from each other, wherein said first and second roller-couples are arranged so that ratio of L/D is less than 30, where L is the center distance between said first and second roller-couples, and D is the wire diameter obtained after the rolling by said second roller-couple which is 5.5 mm or less;

wherein said work material is rolled by said roller-couples so that reduction of area of said work material achieved by each roller-couples is 5–35%, and resulting wire diameter is less than 5.5 mm, and wherein resulting diameter of wire is varied in a designated range by changing the rolling reductions in said first and second roller-couples against said work material in a corresponding range.

14. The method according to claim 13 wherein the ratio, R1/R2, where R1 and R2 are roller-rotation rates in said first and second roller-couples, respectively, is fixed in a designated value, and wherein total rolling reduction against said work material by said first and second roller-couples are varied so that resulting change in the reduction of area of said work material is within 10%.

15. The method according to claim 13 wherein total rolling reduction against said work material by said first and second roller-couples are varied so that resulting change in the reduction of area of said work material is within 40%;

and wherein the ratio, R1/R2, where R1 and R2 are roller-rotation rates of said first and second roller-couple, respectively, is varied according to the value of said total rolling reduction against said work material.

16. The method according to claim 13 wherein shapes and/or sizes of sizing pass of said first and second roller-couples are changed according to the value of said total rolling reduction against said work material.

17. An apparatus for manufacturing wire comprising;

a first roller-couple and a second roller-couple which are arranged adjacently in a feeding direction of work material and roll successively said work material in different directions from each other;

wherein each of said first and second roller-couples comprises two rollers having grooves on the circumferential surface thereof for forming a sizing pass which determines cross sectional shape of said wire;

wherein the width of said grooves are less than 7 mm for said first roller-couple;

wherein the width of said grooves are less than 6 mm for said second roller-couple;

wherein the center distance between said first and second roller-couples is less than 50 mm, wherein said first and second roller-couples are arranged so that the ratio of L/D is less than 30, where L is a center distance between said first and second roller-couples, and D is a wire diameter obtained after the rolling by said second roller-couple;

and wherein said work material is rolled by said roller-couples so that reduction of area of said work material achieved by each roller-couples is 5–35%, and resulting wire diameter is less than 5.5 mm.

18. The apparatus according to claim 17 wherein said first and second roller-couples are arranged alternatingly so that the angle between the rotation axes thereof are almost 90°;

wherein said first roller-couple rolls said work material so that the cross sectional dimension of said work material in a direction of rolling reduction, D1, becomes less than that in a direction perpendicular to said direction of rolling reduction, D2;

and wherein said second roller-couple rolls said work material so that the ratio of said dimensions, D2/D1, is decreased.

19. The apparatus according to claim 17 wherein each of said first and second roller-couples is accompanied with a roller-clearance adjusting mechanism which moves two rollers of each roller-couple relatively to and from each other in the direction of rolling reduction;

and wherein each said roller-clearance adjusting mechanism comprises;

bearing portions which rotatively support the shafts of said two rollers, respectively;

and a bearing rotation mechanism which rotates each said bearing portion around an eccentric axis deviated from a corresponding roller axis in opposite direction, respectively, thereby moving said two rollers relatively to and from each other.

20. The apparatus according to claim 19 wherein said bearing rotation mechanism for said first roller-couple is arranged upstream of said first roller-couple, and said bearing rotation mechanism for said second roller-couple is arranged downstream of said second roller-couple.

21. The apparatus according to claim 20 wherein said bearing rotation mechanism comprises;

first gear portions which are formed on the circumferences of said bearing portions of said two rollers, respectively;

second gear portions each of which engages with corresponding said first gear portion;

and a driving mechanism which rotates said second gear portions synchronously in opposite directions each other.

22. The apparatus according to claim 21 wherein said second gear portions are worms which are axially arranged on a worm rotating shaft at an designated intervals along the longitudinal direction thereof and whose threads are formed in opposite directions each other;

and wherein said driving mechanism drives said worm rotating shaft thereby rotating said worms integrally.

23. The apparatus according to claim 22 wherein said bearing portion comprises;

bearing casings which are arranged corresponding to both end portions of a roller shaft and each of which has a bearing accommodating hole extending along said roller shaft;

bearing main bodies each of which is accommodated in each said bearing accommodating hole;

wherein a bearing hole is formed in each said bearing main body so that the center of said bearing hole is deviated from the rotation axis of said bearing main body, and each end portion of said roller shaft is rotatively supported in said bearing hole;

and wherein said bearing main body has said first gear portion on its circumference and is rotated by said worm engaged with said first gear portion around an eccentric axis deviated from the rotation axis of said roller.

24. The apparatus according to claim 23 wherein said bearing hole of said first roller-couple is formed in said bearing main body deviated from its rotation axis in the downstream, and said bearing hole of said second roller-couple is formed in said bearing main body deviated from its rotation axis in the upstream.

25. The apparatus according to claim 17 wherein at least one of said first and second roller-couples is equipped with a roller thrust adjusting mechanism which moves said two rollers relatively in the thrust direction thereof and hold said two rollers at arbitrary positions in said thrust direction.

26. The apparatus according to claim 25 wherein said roller thrust adjusting mechanism comprises;

a fixed bearing portion which is provided for at least one of said two rollers and hold the roller shaft rotatively and movably in its thrust direction;

and a roller sliding mechanism which is connected to one end portion of said roller shaft and slides said roller shaft against said bearing portion in said thrust direction.

27. The apparatus according to claim 26 wherein said roller sliding mechanism comprises;

a shaft holder to which said end portion of said roller shaft is connected and which is movable integrally with said roller shaft in said thrust direction;

adjusting screw mechanism which is connected to said shaft holder directly or indirectly with other member and moves said shaft holder in said thrust direction according to its screwing or unscrewing operation.

28. The apparatus according to claim 27 wherein said bearing portion comprises a bearing main body which has a through hole as a bearing hole in the direction of said roller shaft and rotatively supports said one end portion of said roller shaft in said through hole;

wherein said shaft holder is movable in said through hole with said roller shaft in said thrust direction;

wherein said shaft holder has a shaft-like protruding portion which extends along the axial direction of said roller shaft in said through hole and the end portion of which protrudes outside from the corresponding opening of said through hole;

wherein on the inner side of said through hole, a female threaded portion is formed on the end portion thereof leading to said opening;

wherein a male screw member is screwed on said female threaded portion in a position corresponding to the intermediary part of said shaft-like protruding portion;

wherein a stopper is mounted on said shaft-like protruding portion for preventing said male screw member from its relative movement against said shaft-like protruding portion in the axial direction thereof;

and wherein said adjusting screw mechanism moves said shaft holder and said roller shaft in said thrust direction along with said male screw member according to the rotation of said male screw member.

29. An apparatus for manufacturing wire comprising:

a first roller-couple and a second roller-couple which are arranged adjacently in a feeding direction of work material and roll successively said work material in different directions each other;

wherein clearance formed between two rollers is less than 7 mm for said first roller-couple;

wherein clearance formed between two rollers is less than 6 mm for said second roller-couple;

and wherein the center distance between said first and second roller-couples is less than 50 mm, wherein said first and second roller-couples are arranged so that the ratio of L/D is less than 30, where L is a center distance between said first and second roller-couples, and D is a wire diameter obtained after the rolling by said second roller-couple;

and wherein said work material is rolled by said roller-couples so that reduction of area of said work material achieved by each roller-couples is 5–35%, and resulting wire diameter is less than 5.5 mm.

30. An apparatus for manufacturing wire comprising;

a scale-removing device which is arranged on the passage of feeding of work material and continuously removes the scale formed on said work material in continuous feeding;

a heating device for heating said work material after the removal of said scale comprising an electrode contacting with said work material allowing the feeding thereof and sending electric current into said work material through said electrode for resistance-heating said work material;

a rolling mill which comprises a first roller-couple and a second roller-couple which are arranged adjacently in the direction of work material transportation and roll said work material successively in different directions from each other so that L/D is less than 30, where L is the center distance between said first and second roller-couples, and D is the wire diameter obtained after the rolling by said second roller-couple, and wherein said work material is rolled by said roller-couples so that reduction of area of said work material achieved by each roller-couples is 5–35%, and resulting wire diameter is less than 5.5 mm.

31. The apparatus according to claim 30 wherein said scale-removing device comprises a shot-blasting device which removes said scale by blasting a flow of abrasive particles onto the surface of said work material in continuous feeding.

32. The apparatus according to claim 30 wherein said heating device comprises;

a roller electrode which contacts with said work material and sends electric current into said work material for its resistance-heating;

and an urging mechanism which urges said roller electrode against said work material.

33. The apparatus according to claim 30 wherein the distance between said heating device and said rolling mill is less than 4 m.

34. An apparatus for manufacturing wire comprising:

a heating device comprising an induction heating coil for heating work material in continuous feeding which is arranged on the way of said feeding;

a rolling mill which comprises a first roller-couple and a second roller-couple which are arranged adjacently in the feeding direction of said work material and roll said work material successively in different directions each other so that L/D is less than 30, where L is the center distance between said first and second roller-couples, and D is the wire diameter obtained after the rolling by said second roller-couple, and wherein said work material is rolled by said roller-couples so that reduction of area of said work material achieved by each roller-couples is 5–35%, and resulting wire diameter is less than 5.5 mm.

35. The apparatus according to claim 34 wherein the distance between said heating device and said rolling mill is less than 4 m.

36. An apparatus for manufacturing wire by rolling work material successively with a first roller-couple and a second roller-couple which are arranged adjacently in a feeding direction of said work material and roll said work material in different directions from each other, wherein rolling reduction against said work materially each roller-couple is varied according to the variety of said work material, and the ratio, R1/R2, where R1 and R2 are roller-rotation rates in said first and second roller-couples, respectively, is adjusted according to said rolling reduction, wherein said first and second roller-couples are arranged so that the ratio of L/D is less than 30, where L is the center distance between said first and second roller-couples, and D is a wire diameter obtained after the rolling by said second roller-couple;

and wherein said work material is rolled by said roller-couples so that reduction of area of said work material achieved by each roller-couples is 5–35%, and resulting wire diameter is less than 5.5 mm.

37. The apparatus according to claim 36 wherein said first and second roller-couples are driven by a common driving means through a first and a second reduction gear systems, respectively;

and wherein the inter-stand reduction ratio, Q1/Q2, where Q1 is the reduction gear ratio of said first reduction gear system and Q2 is the reduction gear ratio of said second reduction gear system, is varied for changing said ratio of roller rotation rates, R1/R2.

38. The apparatus according to claim 37 wherein a plurality of roller-couple units each of which comprises said first and second roller-couples are arranged in the feeding direction of said work material, and said work material is successively rolled by said roller-couple units;

wherein said inter-stand reduction ratios Q1/Q2 of said roller-couple units are changed synchronously;

and wherein when said inter-stand reduction ratio is set in a designated value for one of roller-couple unit, the inter-stand reduction ratios for another roller-couple units are also set in corresponding values synchronously.

39. An apparatus for manufacturing wire by rolling work material successively with a first roller-couple and a second roller-couple which are arranged adjacently in a feeding direction of said work material and roll said work material in different directions from each other, wherein said first and second roller-couples are arranged so that the ratio of L/D is less than 30, where L is the center distance between said first and second roller-couples, and D is a wire diameter obtained after the rolling by said second roller-couple;

wherein said work material is rolled by said roller-couples so that reduction of area of said work material achieved by each roller-couples is 5–35%, and resulting wire diameter is less than 5.5 mm, and wherein resulting wire diameter is varied in a designated range by changing the rolling reductions in said first and second roller-couples against said work material in a corresponding range.

40. The apparatus according to claim 39 wherein the ratio, R1/R2, where R1 and R2 are roller-rotation rates in said first and second roller-couple, respectively, is fixed in a designated value, and wherein total rolling reduction against said work material by said first and second roller-couples are varied so that resulting change in the reduction of area of said work material is within 10%.

41. The apparatus according to claim 39 wherein total rolling reduction against said work material by said first and second roller-couples are varied so that resulting change in the reduction of area of said work material is within 40%;

and wherein the ratio, R1/R2, where R1 and R2 are roller-rotation rates in said first and second roller-couple, respectively, is varied according to the value of said total rolling reduction against said work material.

42. The apparatus according to claim 41 wherein said first and second roller-couples are driven by a common driving means through a first and a second reduction gear systems, respectively;

and wherein the inter-stand reduction ratio, Q1/Q2, where Q1 is the reduction gear ratio of said first reduction gear system and Q2 is the reduction gear ratio of said second reduction gear system, is varied for changing said ratio, R1/R2.

43. The apparatus according to claim 42 wherein a plurality of roller-couple units each of which comprises said first and second roller-couples are arranged in the feeding direction of said work material, and said work material is successively rolled by said roller-couple units;

wherein said inter-stand reduction ratios Q1/Q2 of said roller-couple units are changed synchronously;

and wherein when said inter-stand reduction ratio is set in a designated value for one of roller-couple unit, the inter-stand reduction ratios for other roller-couple units are also set in corresponding values synchronously.

* * * * *